US008833361B2

(12) United States Patent
O'Keefe et al.

(10) Patent No.: US 8,833,361 B2
(45) Date of Patent: Sep. 16, 2014

(54) COLLAPSIBLE SAFETY SHIELD FOR APPLIANCE

(75) Inventors: Colleen O'Keefe, New York, NY (US); David E. Gaber, Hoboken, NJ (US); Chi Wo Wong, New Territories (HK)

(73) Assignee: Designer Safety Knob, LLC, Hoboken, NJ (US)

( * ) Notice: Subject to any disclaimer, the term of this patent is extended or adjusted under 35 U.S.C. 154(b) by 711 days.

(21) Appl. No.: 12/956,430

(22) Filed: Nov. 30, 2010

(65) Prior Publication Data

US 2011/0126817 A1 Jun. 2, 2011

Related U.S. Application Data

(60) Provisional application No. 61/265,204, filed on Nov. 30, 2009.

(51) Int. Cl.
*F24C 15/36* (2006.01)
*F24C 15/12* (2006.01)

(52) U.S. Cl.
CPC ..... *F24C 15/12* (2013.01)
USPC ..... 126/201; 126/42; 126/214 D; 160/35; 160/202

(58) Field of Classification Search
USPC ..... 126/201, 214 D, 42; 160/35, 202
See application file for complete search history.

(56) References Cited

U.S. PATENT DOCUMENTS

| | | | | | |
|---|---|---|---|---|---|
| 2,431,933 | A | * | 12/1947 | Hartmann | 52/645 |
| 2,778,356 | A | | 1/1957 | Pugach | 126/42 |
| 3,513,826 | A | | 5/1970 | Hellmuth | 126/211 |
| 3,570,579 | A | * | 3/1971 | Matsushima | 160/235 |
| 4,139,042 | A | * | 2/1979 | Watanabe et al. | 160/36 |
| 4,150,664 | A | | 4/1979 | Trombatore | 126/299 C |
| 4,155,343 | A | | 5/1979 | Hartman | 126/211 |
| 4,157,705 | A | | 6/1979 | Caan | 126/211 |
| 4,237,856 | A | | 12/1980 | Trombatore | 126/299 C |
| 4,379,478 | A | | 4/1983 | Lichy | 160/35 |
| 4,790,037 | A | | 12/1988 | Phillips | 4/499 |
| 4,836,181 | A | | 6/1989 | Saga | 126/42 |
| 4,964,393 | A | | 10/1990 | Knudsen | 126/211 |
| 5,076,255 | A | | 12/1991 | Harrison | 126/42 |
| 5,133,398 | A | * | 7/1992 | Yang et al. | 160/33 |
| 5,450,840 | A | * | 9/1995 | Kozdas | 126/42 |
| 5,546,928 | A | | 8/1996 | Lewis et al. | 126/214 |

(Continued)

FOREIGN PATENT DOCUMENTS

EP 0 251 974 1/1988

OTHER PUBLICATIONS

International Preliminary Report on Patentability issued in International Application No. PCT/US2010/058334 on Jun. 14, 2012, 8 pages.

*Primary Examiner* — Kenneth Rinehart
*Assistant Examiner* — Gajanan M Prabhu
(74) *Attorney, Agent, or Firm* — Pillsbury Winthrop Shaw Pittman LLP

(57) ABSTRACT

A collapsible shield acts as a safety device for a stove when in a second, expanded, position by limiting access to (or interaction with) items on a stove top, thereby preventing possible burns or injuries around the stove. The collapsible shield may be stored and concealed in a first, collapsed position when not in use. The collapsible shield includes at least a first, proximal segment and a second, distal segment which is configured to move vertically and pivotally with respect to the first, proximal segment.

24 Claims, 17 Drawing Sheets

(56) References Cited

U.S. PATENT DOCUMENTS

| | | | | |
|---|---|---|---|---|
| 5,758,636 | A | 6/1998 | Butrimas et al. | 126/211 |
| 5,813,396 | A * | 9/1998 | Bessette | 126/214 D |
| 5,829,947 | A | 11/1998 | Litten | 414/537 |
| 5,842,464 | A | 12/1998 | Koch | 126/42 |
| 6,339,905 | B1 | 1/2002 | Craig | 52/174 |
| 6,371,105 | B1 | 4/2002 | Merritt | 126/42 |
| 6,769,141 | B2 | 8/2004 | Epple et al. | 4/502 |
| 7,549,417 | B2 | 6/2009 | Dang | 126/42 |

* cited by examiner

A-A 52
60b
FRONT OF SHIELD
34
46
44
58
Z
X
30
60a
40

52
60b
110
128
34
46
44
58
Z
X
60a
138
B
40

A
52
FINGER PULL-UP
60b
110
34
46
44
58
Z
X
60a
138
40

COLLAPSIBLE SAFETY SHIELD FOR APPLIANCE

CROSS-REFERENCE TO RELATED APPLICATIONS

This application claims priority to U.S. Provisional Patent Application Ser. No. 61/265,204, filed Nov. 30, 2009, which is hereby incorporated by reference herein in its entirety.

FIELD OF THE INVENTION

The invention relates generally to a collapsible safety shield for an appliance, such as a stove.

BACKGROUND OF THE INVENTION

Preventing injury while using a cooking appliance is critical, as some circumstances may have dangerous repercussions. For example, safety concerns arise when small children are able to access items on a working stove. Particularly, a child may accidentally touch a stove burner and/or try and grab hot pot(s) and/or pan(s) on a stove burner. Additionally, items that are being heated (e.g., oil or water) may splash, spatter, or spill, and cause possible burns or injury. In view of these concerns, some stoves are provided with a screen or guard to prevent injuries. However, known safety guards can require extra storage space once removed from the stove when not in use. Some safety guards are also cumbersome and unattractive. These and other drawbacks exist.

SUMMARY OF INVENTION

The invention described herein is directed to a collapsible shield configured to be attached to a surface of a device. The collapsible shield includes: at least a first segment and a second segment, each segment comprising a top portion, a bottom portion, a front portion, a back portion, and left and right end portions forming a generally rectangular body configured to extend horizontally in relation to the surface of the device. The at least first segment and the second segment are configured for movement between a first, collapsed position that provides access to a surface of the device and a second, expanded position that limits access to a surface of the device. Each segment has at least one slot provided at or adjacent each of the left and the right end portions. The at least first segment and the second segment are connected to one another by connection devices provided in each of the slots. The connection devices enable vertical and pivotal movement of the second segment with respect to the first segment. Also, the second segment is configured to move in a vertical and a pivotal direction with respect to the first segment when the collapsible shield is moved between a first, collapsed position and a second, expanded position, or vice versa. The generally rectangular body of the first segment and the generally rectangular body of the second segment are stacked in a vertical configuration with respect to one another in a second, expanded position.

According to another implementation, the invention is directed to a collapsible shield configured to be attached to a stove. The stove has a top surface and a number of burners on the top surface. The collapsible shield includes: a plurality of interconnected segments, each segment comprising a top portion, a bottom portion, a front portion, a back portion, and left and right end portions forming a generally rectangular body configured to extend horizontally in relation to the surface of the stove. Each segment also has least one slot provided at or adjacent the left end portion and at least one slot provided at or adjacent the right end portion. The plurality of interconnected segments is connected to one another by connection devices provided through the slots. Each connection device is configured to connect adjacent segments to one another. The plurality of interconnected segments is configured for movement between a first, collapsed position that provides access to a (e.g., top) surface of the stove and a second, expanded position that limits access to a (e.g., top) surface of the stove. The collapsible shield also includes a housing attached to the stove. The housing has a body configured to store the plurality of interconnected segments therein when the collapsible shield is in a first, collapsed position. The connection devices enable vertical and pivotal movement of the plurality of interconnected segments when the plurality of interconnected segments is moved between a first, collapsed position and a second, expanded position, or vice versa. The bodies of the plurality of interconnected segments is stacked in a vertical configuration with respect to one another in a second, expanded position.

Various objects, features, and advantages of the invention will be apparent through the detailed description of the implementations and the drawings attached hereto. It is also to be understood that both the foregoing general description and the following detailed description are exemplary and not restrictive of the scope of the invention.

DETAILED DESCRIPTION OF THE INVENTION

Figure 1A:
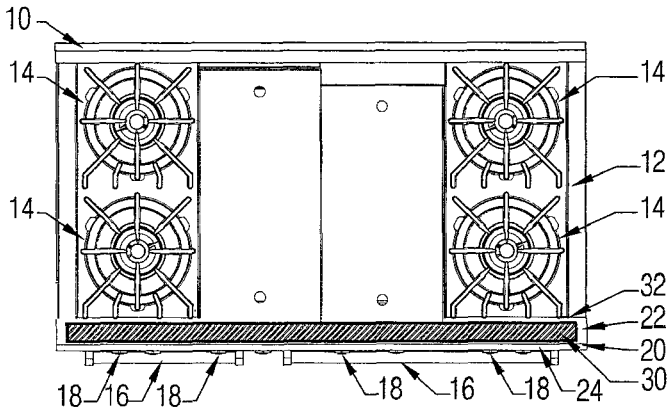
FIGS. 1A, 1B, and 1C are exemplary illustrations of a top view, front view, and side view, respectively, of a stove with a collapsible shield attached thereto, in a first (collapsed, unused) position, according to an aspect of the invention.
Figure 1B:
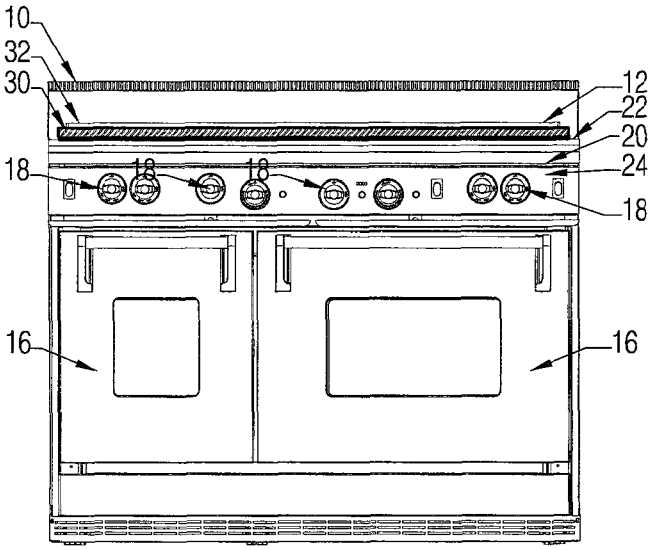
Figure 1C:
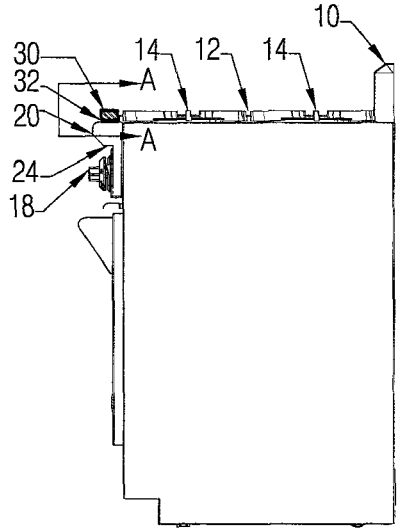
Figure 6:
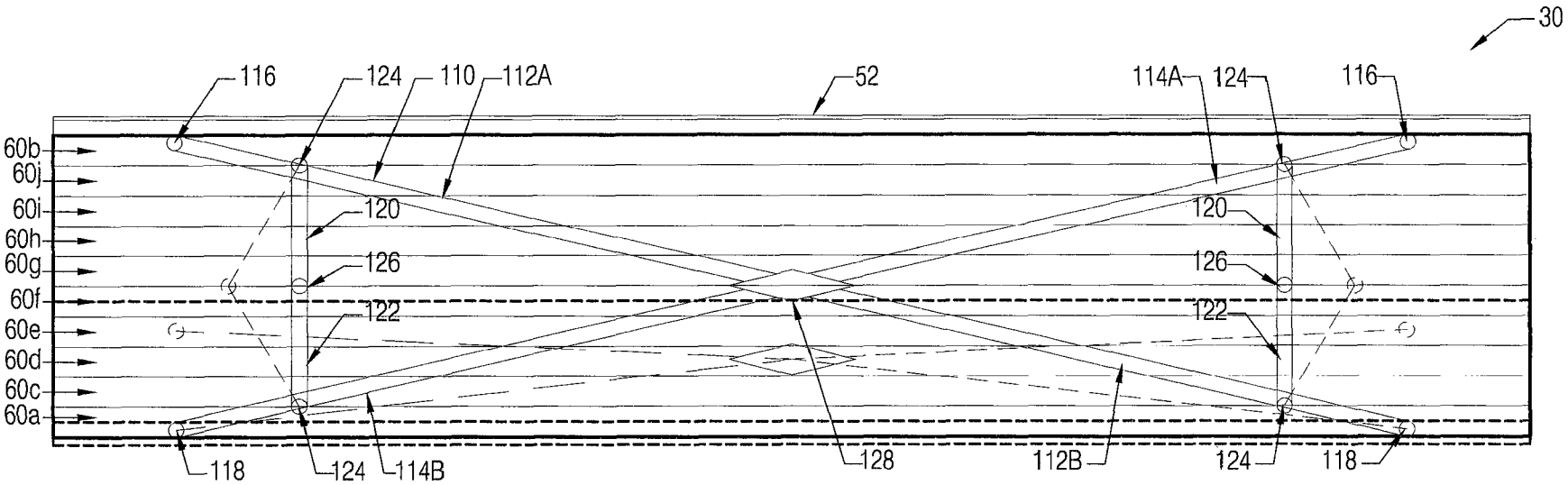
FIG. 6 is an exemplary illustration of a front view of the collapsible shield in a second (expanded, in use) position with a lock mechanism, according to an aspect of the invention.
Figures 7A, 7B, 7C:
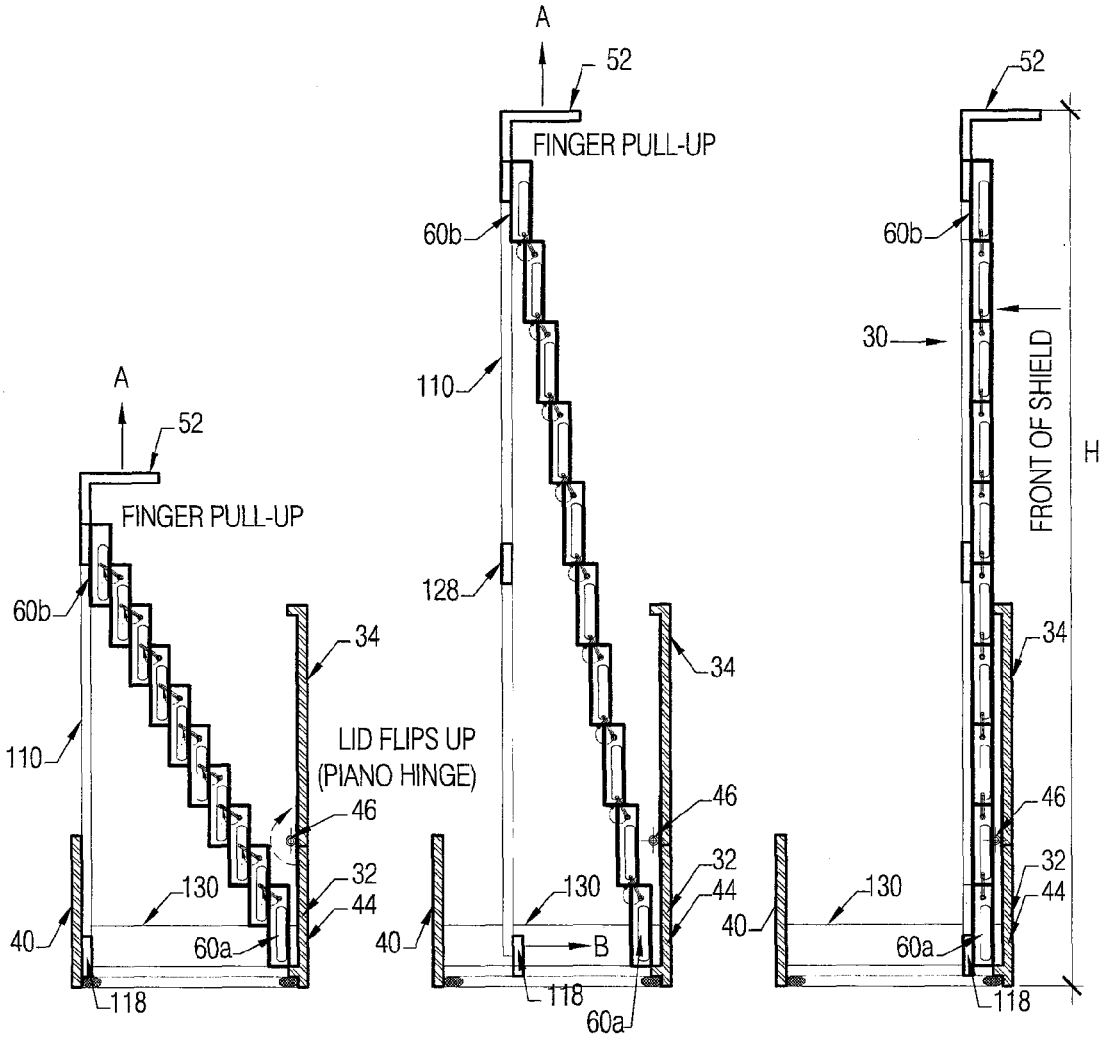
FIG. 7A is an exemplary illustration of a sectional view of the collapsible shield of FIGS. 2A-2C moved to a first partially extended position, according to an aspect of the invention.
FIG. 7B is an exemplary illustration of a sectional view of the collapsible shield of FIGS. 2A-2C in a second partially extended position, according to an aspect of the invention.
FIG. 7C is an exemplary illustration of a sectional view of the collapsible shield in a second (expanded, in use) position, according to an aspect of the invention.

FIGS. 1A, 1B, and 1C are exemplary illustrations of a top view, a front view, and a side view, respectively, of a stove 10 having a collapsible shield 30 attached thereto, according to an aspect of the invention. Collapsible shield 30 may be in a first (collapsed, unused) position (e.g., as shown in FIGS. 1A-1C) or in a second (expanded, in use) position (e.g., as shown in FIGS. 6 and 7C). As will be described in greater detail herein, collapsible shield 30 (and its constituent components) acts as a safeguard in a second (expanded, in use) position by blocking (or obstructing) access to items on a stove top 12 including, for example, burners 14 or pots and/or pans (and the liquids or food items therein) on burners 14, and by protecting from splashes, spatters, or spills. This prevents possible burns or injuries that may occur to individuals which may be around stove 10, such as children, for example.

Although the description herein references the use of collapsible shield 30 as a safety mechanism for stove 10, it should be understood that collapsible shield 30 may be used with any number of other appliances or devices, including those for which safety may not necessarily be a concern. For example, shield 30 may be used with, but not limited to, desks, workstations, shelving, or other appliances or devices. Accordingly, the description and accompanying drawing figures are exemplary in nature, and should not be viewed as limiting.

Additionally it should be recognized that any use of orientation-specific language herein (e.g., up/down, upper/lower, above/below, top/bottom, left/right, inward/outward, etc.) is for ease of explanation with respect to the disclosed and illustrated implementations, and should in no way be viewed as limiting.

In one exemplary and non-limiting implementation as shown in FIGS. 1A-1C, collapsible shield 30 may be utilized with a cooking appliance, such as a stove 10 (or range). Stove 10 may include one or more ovens 16 as well as a stove top 12 having any number of burners 14 and control knobs 18, as known and understood by those having skill in the art. The control knobs 18 may be operatively coupled to a front-facing surface, upwardly facing surface, or other surface of stove 10, depending on the style of the appliance. In the illustrated implementation, control knobs 18 are provided on a front edge 20, in front of burners 14. Front edge 20 comprises a top surface 22 and a forward (side) surface 24.

In some implementations, collapsible shield 30 may be provided on top surface 22 of front edge 20. More particularly, collapsible shield 30 may be configured to be stored in a housing 32. Housing 32 comprises a length, width, and depth/thickness to house components of collapsible shield 30 when collapsible shield 30 is in a first (collapsed, unused) position. Housing 32 may be secured to top surface 22 of front edge 20 of stove 10, for example. As such, in some implementations, housing 32 may comprise at least a length and a width that are sized based on the dimensions of top surface 22 of stove 10. Housing 32 may be a rectilinear housing that extends the width of edge 22, for example. In some implementations, collapsible shield 30 and housing 32 are removable from front edge 20 of stove 10. A heat-resistant adhesive or glue 50 may be used to attach housing 32 to top surface 22, for example. Other means of attachment (e.g., screws or other fasteners) may be utilized. Alternatively, in another implementation (as described below with reference to FIGS. 8A-8C), an attachment portion 26 and/or elevation plate 28 may be used to secure housing 32 to front edge 20 of stove 10.

Figure 2A:
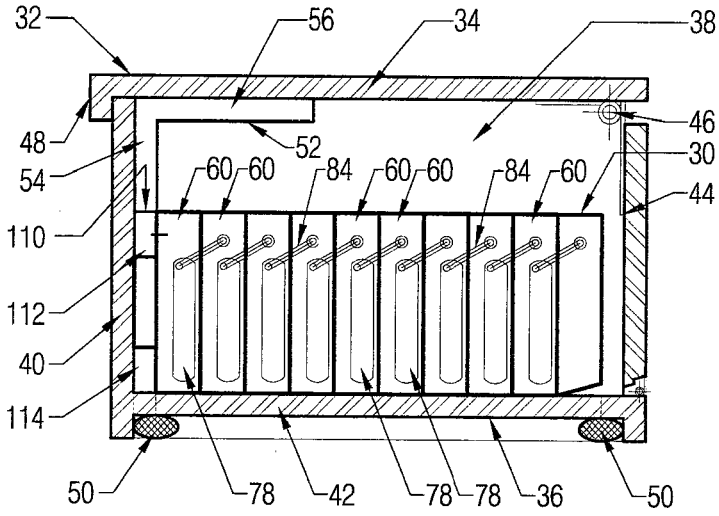
FIGS. 2A, 2B, and 2C are exemplary illustrations of a sectional view, a front view, and a side sectional view, respectively, of a collapsible shield in a first (collapsed, unused) position in a housing, according to an aspect of the invention.
Figure 2B:
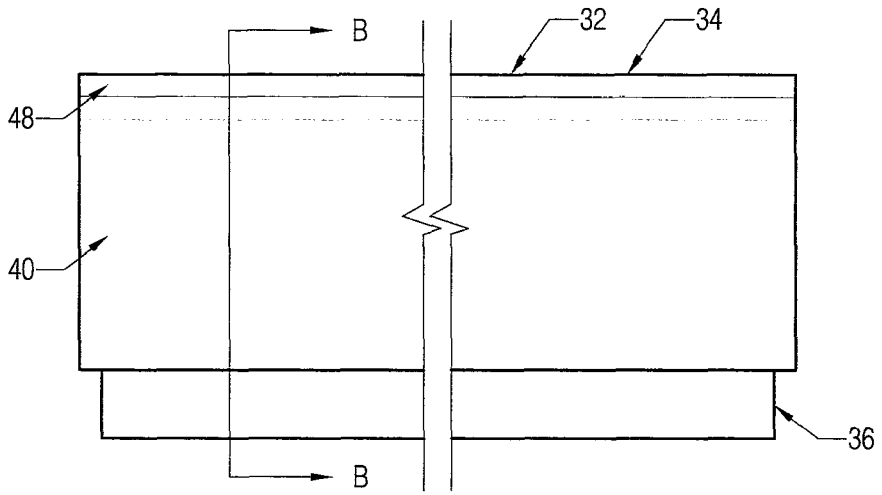
Figure 2C:
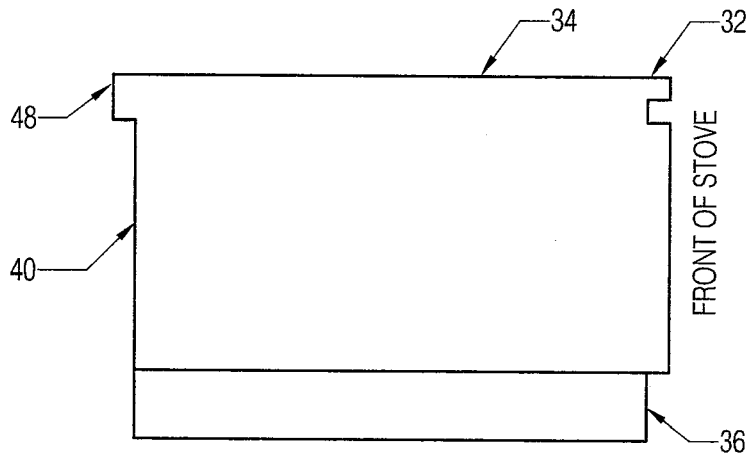

A sectional view of collapsible shield 30 (as indicated by section A-A in FIG. 1C) in a first (collapsed, unused) position in housing 32 is illustrated in FIG. 2A. FIGS. 2B and 2C show a front view and a side sectional view (as indicated by section B-B in FIG. 2B) of collapsible shield 30 in a first (collapsed, unused) position in housing 32. As shown, housing 32 may comprise a lid 34 and a body 36 for housing collapsible shield 30. Body 36 comprises a channel 38 that is formed from a first (front) wall 40, a second (bottom) wall 42, and a third (back) wall 44 which are connected to form an approximate "U" shape. Channel 38 of body 36 receives the parts of collapsible shield 30 when they are collapsed and not in use, as further described below. Body 36 may be sized or formed such that collapsible shield 30 is easily stored therein. Lid 34 is attached to body 36 and may be provided in a first (closed) configuration (e.g., see FIG. 2A) or a second (open) configuration (e.g., see FIG. 7A). In another implementation, lid 34 may be provided in a third (open) configuration (e.g., see FIG. 9C which is discussed in detail below). Lid 34 may be connected to body 36, for example, via a piano hinge 46 or a similar mechanism that enables movement between the first and second positions. For example, piano hinge 46 may connect lid 34 at one end to third (back) wall 44 such that, when lid 34 is flipped upward and pivoted around an axis of piano hinge 46 into the second (open) configuration, an end of lid 34 is adjacent to third (back) wall 44. Lid 34 may also include a lip 48 which extends over first (front) wall 40 when in a first (closed) configuration.

In one implementation, collapsible shield 30 comprises a manual actuation device 52 which is attached to collapsible shield 30 to facilitate movement of collapsible shield 30 between a first position and second position. In one implementation, as shown in the sectional view of FIG. 2A, manual actuation device 52 is provided in the form of a pull mechanism which may be pushed or pulled in a vertical direction to respectively collapse or expand collapsible shield 30. Manual actuation device 52 may comprise a non-limiting, substantially "L"-shaped structure formed from vertical piece 54 and horizontal piece 56, and may be stored within housing 32 when collapsible shield 30 is in a first (collapsed, unused) position. Manual actuation device 52 may be accessed when lid 34 is flipped (or pivoted) open. Manual actuation device 52 may be provided along an entire length of shield 30 or in designated actuation areas for lifting the shield 30. The configuration and placement of manual actuation device 52 is not limited.

Collapsible shield 30 also comprises a plurality of segments 60. As will become further evident throughout the description, collapsible shield 30 may comprise any number of segments (60*a*, 60*b*, . . . 60*n*). An exemplary implementation of a single segment 60 is represented in a side view in FIG. 3. Each segment 60 may comprise a generally rectangular body 62 that extends horizontally between a right end 64 and a left end 66. The length of each segment 60 may be sized based on the dimensions of front edge 20 of stove 10. More particularly, the dimensions of each segment 60 may be formed such that each segment 60 may be inserted (and stored) in channel 38 of housing 32. Each segment 60 also comprises a first (proximal, bottom) portion 68, a second (distal, top) portion 70, and side (e.g., left and right) portions 72 and 74. Each segment 60 also includes an attachment area 76 and a slot 78. Attachment area 76 may be used to attach a first segment 60*a* to another segment 60*n*. Attachment area 76 may be provided at both ends 64 and 66 of the segment 60. In the illustrated (non-limiting) implementation, for example, each attachment area 76 comprises an opening, bore, or passage (as better illustrated in FIG. 4) that extends laterally/horizontally into ends (64, 66) of body 62 of segment 60. Attachment area 76 may be configured to receive a part of a connection device that is used to connect a segment 60 to another segment 60*n*.

The design and configuration of attachment area 76 should not be viewed as limiting. Attachment area 76, in some implementations, for example, may not comprise an opening or bore as described and illustrated. Attachment area 76 may be formed according to the type of connection device to be used to connect segments 60*a*-60*n* together.

Slot 78 may comprise an opening, bore, or passage that extends at least partially laterally/horizontally into end of segment 60, as well as longitudinally/vertically within body 62. Slot 78 has a proximal end 80 that is provided near the first (proximal) portion 68 and a distal end 82 that is provided near the second (distal) end portion 70 of segment 60. As described below, the configuration of slot 78 enables vertical and pivotal movement of a second segment 60*b* with regard to a first segment 60*a*, when collapsible shield 30 is moved between a first (collapsed, unused) position and a second (expanded, in use) position, or vice versa.

Generally, collapsible shield 30 comprises at least a first (proximal, bottom) segment 60*a* and a second (distal, top) segment 60*b* which are configured to move relative to one another. In one implementation, first segment 60*a* and second segment 60*b* may be directly connected to one another. In one implementation, first segment 60*a* and second segment 60*b* may be connected via a plurality of segments 60 provided therebetween. In either instance, second segment 60*b* is configured such that it moves vertically and is pivoted with respect to first segment 60*a*.

Figure 4:
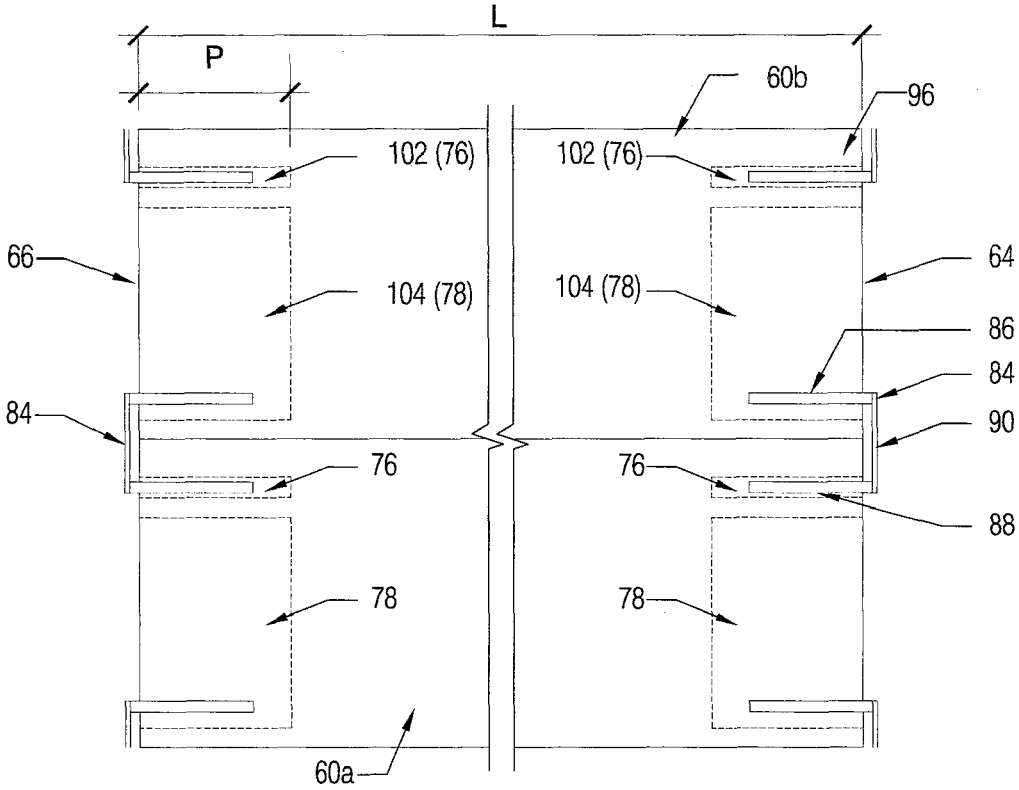
FIG. 4 is an exemplary illustration of a front view of two segments of the collapsible shield in a second (expanded, in use) position, according to an aspect of the invention.

In an implementation where the two segments (60*a*, 60*b*) are directly connected to one another, such as shown in FIG. 4 for example, a connection device that enables vertical and pivotal movement is used. In an implementation, first segment 60*a* may be connected to a second segment 60*b* via a pin hinge 84. For example, pin hinge 84 may comprise two pins 86 and 88 which are spaced from one another via a connection leg 90. First and second pins 86 and 88 of pin hinge 84 may be designed such that they can be inserted and mounted into segments 60*a* and 60*b* to thereby connect two adjacent segments of the collapsible shield 30. The design and/or dimensions of attachment area 76 may be configured to correspond to a shape of a second pin 88 of a pin hinge 84. Similarly, slot 78 may be configured such that a first pin 86 of pin hinge 84 may be inserted therein.

In one implementation, second pin 88 of pin hinge 84 may be secured into attachment area 76 of first segment 60*a*, or mounted in a similar manner. First pin 86 of pin hinge 84 may be secured into slot 104 of second segment 60*b* (as further described below). The area 76 and slot 78 of each segment may be configured such that, as the segments are pulled into a stacked position (or pushed into a collapsed position), pins 86 and 88 can move therein. For example, attachment area 76 may be configured such that second pin 88 may rotate and shift therein. Attachment area 76 may be sized such that when pin 88 is inserted therein, there is a small clearance area that allows for rotation of the pin while still securing pin 88 therein. Slot 78 may be configured such that first pin 86 allows pin 86 to shift vertically when the segments 60*a* and 60*b* are moved relative to one another.

To further explain the relative movement of segments 60*a* and 60*b*, FIGS. 5A-5D illustrate first (proximal) segment 60*a* directly connected via pin hinge 84 to second (distal) segment 60*b*, as well as the corresponding movement of parts relative to one another from a first (collapsed, unused) position to a second (expanded, in use) position. However, it should be understood that two segments of collapsible shield 30 which are not directly connected to one another may also move in a similar, vertical, pivoting and translating manner as described herein. As such, the description corresponding to FIGS. 5A-5D should not be limited to two segments which are directly connected to (or adjacent) one another, but should rather be understood to describe a first (proximal, bottom) segment 60*a* and second (distal, top) segment 60*b*, and their movement with respect to one another, regardless of the number of segments 60*a*-60*n* provided in collapsible shield 30.

Figure 3:
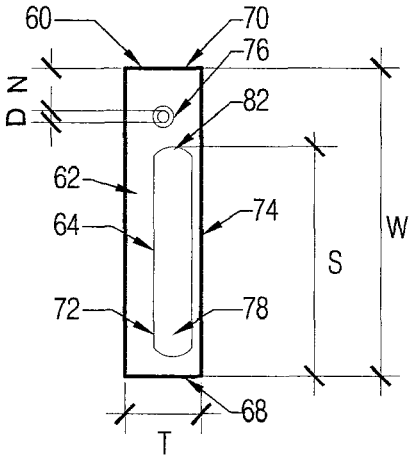
FIG. 3 is an exemplary illustration of a side view of a single segment of the collapsible shield of FIGS. 2A-2C, according to an aspect of the invention.

First segment 60*a* comprises similar elements described with respect to single segment 60 of FIG. 3, including first portion 68, second portion 70, side portions 72 and 74, attachment area 76 and slot 78. Second segment 60*b* comprises elements similar to those of first segment 60*a*. For ease of explanation only, second segment 60*b* is described as comprising a body 92 with a first portion 94, second portion 96, side portions 98 and 100, an attachment area 102, and a slot 104 having a proximal end 106 and a distal end 108. However, it should be understood that portions 68 and 94, 70 and 96, etc. are substantially similar in shape and construction for the segments 60, and are therefore interchangeable with regard to the description herein.

Figures 5A, 5B, 5C, 5D:
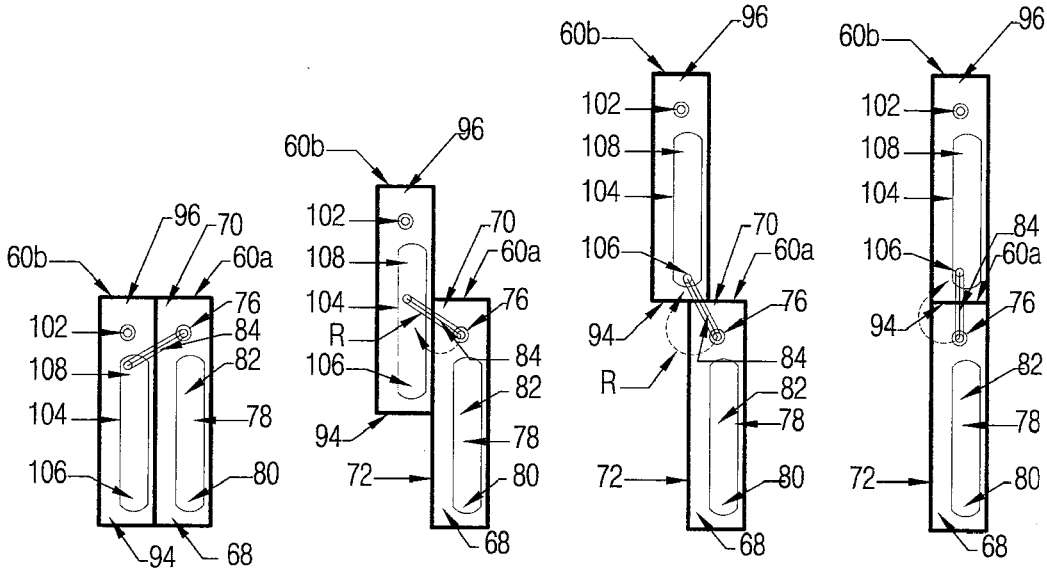
FIGS. 5A, 5B, 5C, and 5D are exemplary illustrations of side views of two segments of the collapsible shield and their corresponding movement relative to one another from a first (collapsed, unused) position to a second (expanded, in use) position, according to an aspect of the invention.

Referring back to FIGS. 5A-5D, FIG. 5A illustrates first (proximal) and second (distal) segments 60*a* and 60*b*, respectively, provided adjacent to one another. As shown, pin hinge 84 is connected via first pin 86 to attachment area 76 of first segment 60*a*, and second pin 88 is provided in distal end 108 of slot 104 of second segment 60*b*. First (proximal) portions 68 and 94 and second (distal) portions 70 and 96 are provided adjacent to one another in a generally parallel configuration when the segments 60*a*-60*b* are in a first (collapsed, unused) position. When collapsible shield 30 is moved to a second (expanded, in use) position, at least second segment 60*b* is moved vertically upward from first segment 60*a*. As shown in FIG. 5B, first portion 94 of second segment 60*b* thus moves away from first portion 68 of first segment 60*a* and toward second (distal) portion 70. Similarly, distal portion 96 also moves vertically away from first and second portions 68 and 70 of first segment 60*a*. Also, first pin 86 of pin hinge 84 is rotated about an axis in attachment area 76 of first segment 60*a*, as indicated by arrow "R." Additionally, second pin 88 of pin hinge 84 is concurrently moved vertically from distal end 108 of slot 104 toward proximal end 106 of slot 104.

As second segment 60*b* continues to move vertically, second pin 88 of pin hinge 84 is moved into proximal end 106 of slot 104 of second segment 60*b*, as shown in FIG. 5C. This enables pivotal movement of second segment 60*b* with respect to first segment 60*a*, as shown by arrow "R." More particularly, pin hinge 84 enables further rotation of first pin 86 about an axis of attachment area 76, thereby moving first (proximal) portion 94 of second segment 60*b* into an adjacent and stacked configuration with second (distal) portion 70 of first segment 60*a*, as shown in FIG. 5D.

It is to be understood that a similar yet opposite movement may be described with regard to the first and second segments 60*a* and 60*b* when collapsible shield 30 is moved from a second (expanded, in use) position to a first (collapsed, unused) position. That is, from the stacked configuration, second segment 60*b* pivots relative to first segment 60*a*, and moves vertically (downward) back to a generally parallel configuration.

In one implementation, first segment 60*a* may be attached via a pin hinge 84 to part of housing 32, such as within channel 38, to second (bottom) side 42 of housing 32. Second segment 60*b* may be attached to manual actuation device 52 via an adhesive such as, for example, a heat-resistant glue. Other means of attachment (e.g., screws or other fasteners) may be utilized. As such, when collapsible shield 30 is moved via manual actuation device 52 from a first position to a second position, second segment 60*b* moves in a relatively vertical direction and is pivoted with respect to first segment 60*a*, such that the segments 60*a* and 60*b* are in a stacked configuration.

In one implementation, when collapsible shield 30 is moved to a second position, the at least first and second segments 60*a* and 60*b* may be secured in their stacked configuration via a lock mechanism 110. Lock mechanism 110 may be configured to both collapse and expand with collapsible shield 30 as it is moved between a first (collapsed, unused) position and a second (expanded, in use) position.

FIG. 6 illustrates lock mechanism 110 in greater detail. As shown, collapsible shield 30 is in a second (expanded, in use) position. Lock mechanism 110 may include cross braces 112 and 114 comprising brace sections 112A, 112B and 114A, 114B which are correspondingly moved with collapsible shield 30. That is, cross braces 112 and 114 may be moved vertically between a first position and a second position. Cross braces 112 and 114 may be provided in a crossed or "X" configuration on collapsible shield 30. For example, as depicted, brace sections 112A and 114A are each connected to a second (distal, top) segment 60*b* at a first (top) connection point 116, and brace sections 112B and 114B are connected to a first (proximal, bottom) segment 60*a* at a second (bottom) connection point 118. Brace sections 112A, 112B and 114A, 114B are secured via a stabilizer 128 at their cross connection point. Stabilizer 128 may also be connected in some fashion to collapsible shield 30, for example.

Additionally, to secure and thus lock cross braces 112 and 114 of lock mechanism 110, side latches 120 and 122 are provided near connection points 116 and 118 on either side of collapsible shield 30 as shown in FIG. 6. Both side latches 120 and 122 each comprise a first end and a second end. The first end of side latch 120 is connected to one of brace sections 112A or 114A at a brace connection point 124, while the second end is connected to the first end of the other side latch 122. More specifically, the side latches 120 and 122 are connected to one another at a latch point 126 to form a pivot connection. The second end of side latch 122 is connected to one of brace sections 112B or 114B at brace connection point 124. Latch point 126 enables movement of side latches 120 and 122 from an unlocked position (as indicated by the dashed lines) to a locked position, for example. When lock mechanism 110 is placed into a locked position, such as shown in FIG. 6, collapsible shield 30 is secured in a second (expanded, in use) position.

Alternatively, as shown and described in the implementation of FIGS. 8A-9C, side latches 120 and 122 need not be provided. For example, cross braces 112 and 114 may be configured to automatically lock in place once the shield is fully extended into a locked position. To unlock cross braces 112 and 114, a pull mechanism such as manual actuation device 52 may be pulled upward in a vertical direction, to thereby release cross braces 112 and 114 from their locked position and allow for collapsing into housing 32.

In one implementation, cross braces 112 and 114 may be configured to move within openings or slots located in channel 38 (e.g., brace sections 112B and 114B may be guided within housing 32). Such openings enable cross braces 112 and 114 to be folded and housed in channel 38. The openings may be provided adjacent a joint location of the cross braces 112 and 114, for example. The cross braces 112 and 114 may be secured within channel 38 of housing 32 by known securement devices.

In operation, as shown in FIGS. 7A-7C, collapsible shield 30 may be moved from a first (collapsed, unused) position by flipping or pivoting lid 34 upward about an axis of piano hinge 46. Manual actuation device 52 may then be grasped by a user and pulled in a vertical, upward direction as indicated by arrow "A." FIG. 7A depicts collapsible shield 30 in a first, partially extended position, wherein each of the segments 60*a*, 60*b*, . . . 60*n* are unfolded and moved at least vertically with respect to one another.

As manual actuation device 52 moves vertically upward into a second, partially extended position, as shown in FIG. 7B, lock mechanism 110 is also expanded. Cross braces 112 and 114 are moved and expanded toward the crossed or "X" configuration (as shown in FIG. 6). Side latches 120 and 126 pivot about latch point 126 toward a generally linear configuration. Additionally, at least a bottom connection point 118 may be moved laterally within housing slot 130 toward third (back) wall 44 of housing 32, as indicated by arrow "B."

Once collapsible shield 30 is moved into a second (expanded, in use) position, side latches 120 and 122 of the lock mechanism 110 may be pushed on either side such that they rotate about latch point and are engaged in a linear configuration, as show in FIG. 7C. The segments 60*a*, 60*b*, . . . 60*n* are all unfolded and stacked in a second position, and are supported via cross arm braces 112 and 114 and engaged side latches 120 and 122.

To move collapsible shield 30 into a first position, latch point 126 may be disengaged by pulling side latches 120 and 122 toward the ends of the shield (or ends 64, 66 of the segments 60*a*-60*n*). The segments 60*a*-60*n* and lock mechanism 110 may then be vertically lowered and collapsed into housing 32.

Although a plurality of segments 60*c*, 60*d*, . . . 60*j* are shown between first (lowermost) segment 60*a* and second (uppermost) segment 60*b* which form collapsible shield 30, it should be understood that the number of such segments 60*c*-60*j* are not meant to be limiting. Further, in some implementations, a plurality of segments need not be provided between first segment 60*a* and second segment 60*b*. For example, it is within the scope of the invention that other devices which may be collapsed, rolled, or folded to a first (collapsed, unused) configuration (or position) and expanded to a second (expanded, in use) configuration (or position) may be attached to first and second segments 60*a* and 60*b* to form collapsible shield 30.

The collapsible shield as described above and shown in FIGS. 2A-2C should not be viewed as limiting. For example, an alternate implementation of collapsible shield 30 is shown in FIGS. 8A-9C. For ease of explanation, the description below regarding FIGS. 8A-8C and 9A-9C focuses primarily on the features of alternate collapsible shield 30. However, it should be understood that collapsible shield 30 of FIGS. 8A-8C and 9A-9C may include components similar to those represented in the implementation of FIGS. 1-7C, and as described in detail above. Accordingly, FIGS. 8A-8C and 9A-9C include many of the same reference characters that correspond to the components described above.

In one implementation, an attachment portion 26 may be used to secure housing 32 to front edge 20 of stove 10 when a width of top surface 22 or front edge 20 is narrower than body 36 of housing 32. For example, some stoves may have a narrow space between front burners 14 and front edge 20 of stove 10. Thus, attachment portion 26 may be mounted to front edge 20, and housing 32 may be attached to attachment portion 26. Attachment portion 26 may comprise an elongated block that is substantially the length of front edge 20 of stove 10. In another implementation, attachment portion 26 may comprise one or more pieces that are spaced at a distance from one another. For example any number of pieces (e.g. two or three) may be spaced apart from one another and applied to top surface 22 of front edge 20 of stove 10.

Figure 8A:
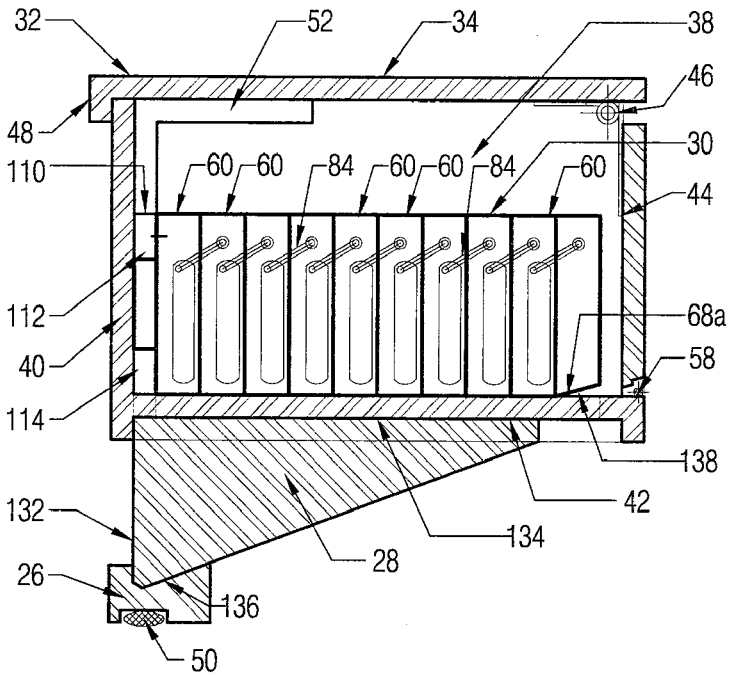
FIGS. 8A, 8B, and 8C are exemplary illustrations of a sectional view, a front view, and a side sectional view, respectively, of an alternate collapsible shield in a first (collapsed, unused) position in a housing, according to an aspect of the invention.
Figure 8B:
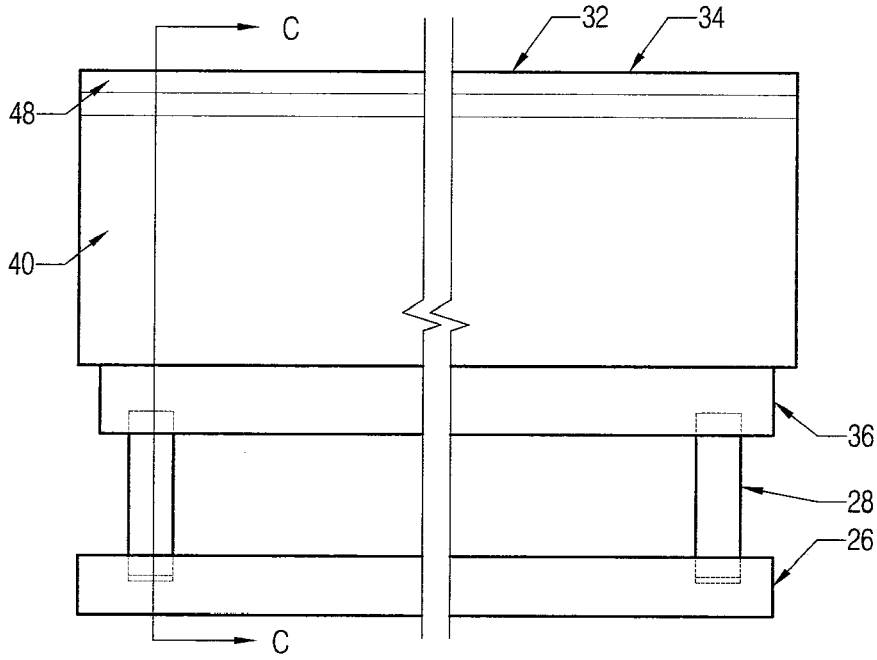
Figure 8C:
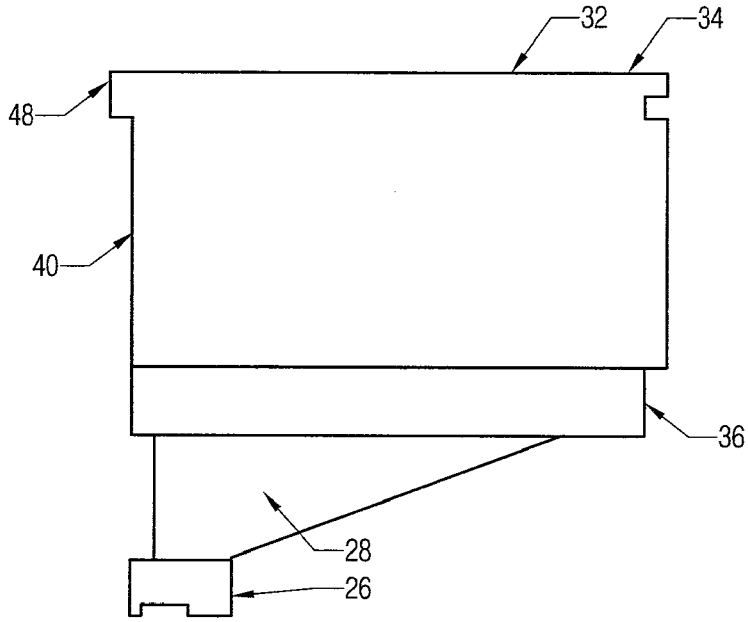

In an implementation, an elevation plate 28 may be provided. In FIGS. 8A-8C, both attachment portion 26 and elevation plate 28 are used to attach housing 32 of collapsible shield 30 to stove 10. As shown, elevation plate 28 may be secured to attachment portion 26 at one side and secured to housing 32 on the other. This may result in collapsible shield 30 being provided at a height above front edge 20 of stove 10, for example. Elevation plate 28 may comprise any number of configurations or shapes that allow for attachment adjacent front edge 20 of stove 10, and for holding collapsible shield 30 above front edge 20 for stove 10. For example, plate 28 may have a narrower, first (lower) edge 132 for attachment to attachment portion 26, and a wider, second (upper) edge 134 for attachment to housing 32. In the implementation depicted, elevation plate 28 comprises a wedge-shaped piece that is inserted or secured to a top of attachment portion 26.

Although the devices are illustrated as separate pieces in the figures, attachment portion 26 and elevation portion 28 may comprise a single device for mounting to stove 10 and housing 32 in another implementation.

Housing 32 of collapsible shield 30 may be attached to attachment portion 26 and/or elevation plate 28 in a number of ways. In FIG. 8A, for example, a heat-resistant adhesive 50 may be used to attach attachment plate 26 to top surface 22. First (lower) edge 132 of elevation plate 28 may be attached to a top of attachment portion 26 in a number of ways. For example, the top of attachment plate 26 may comprise one or more grooves formed therein to receive a body of elevation plate 28. Edge 132 may be secured via a snap-fit connection and/or adhesive. To secure housing 32 to stove 10, second (upper) edge 134 of elevation plate 28 may be configured such that it is secured with respect to body 36. For example, edge 134 may be secured into second (bottom) wall 42 of housing 32 via a snap-fit connection. In one implementation, second (bottom) wall 42 of housing 32 may include one or more grooves on an underside thereof to receive one or more extensions provided on edge 134 (which may be cooperatively engaged in the grooves on the underside of the wall 42), for example. In another implementation, the second (bottom) wall 42 and edge 134 may be secured to one another via heat-resistant adhesive.

FIGS. 8A-9C additionally depict collapsible shield 30 in a tilted (forward) direction. As previously noted, lid 34 may be provided in a third (open) configuration (e.g., see FIG. 9C). For example, piano hinge 46 may connect lid 34 at one end to third (back) wall 44 such that, when lid 34 is flipped upward and pivoted around an axis, third (back) wall 44 also pivots forward (e.g., away from first wall 40), such that the third (back) wall 44 and lid 34 are provided at an angle "Z" with respect to a plane "X" that is parallel to a top of stove 10. For example, third (back) wall 44 may be attached to second (bottom) wall 42 via a hinge mechanism 58 which configures third (back) wall 44 for pivotal movement with respect to housing 32 and stove 10. Third (back) wall 44 may be provided at any angle "Z." In one implementation, angle "Z" is within a range of 60 degree to 80 degrees. In another implementation, angle "Z" is 75 degrees. Other angles may be utilized.

Figures 9A, 9B, 9C:
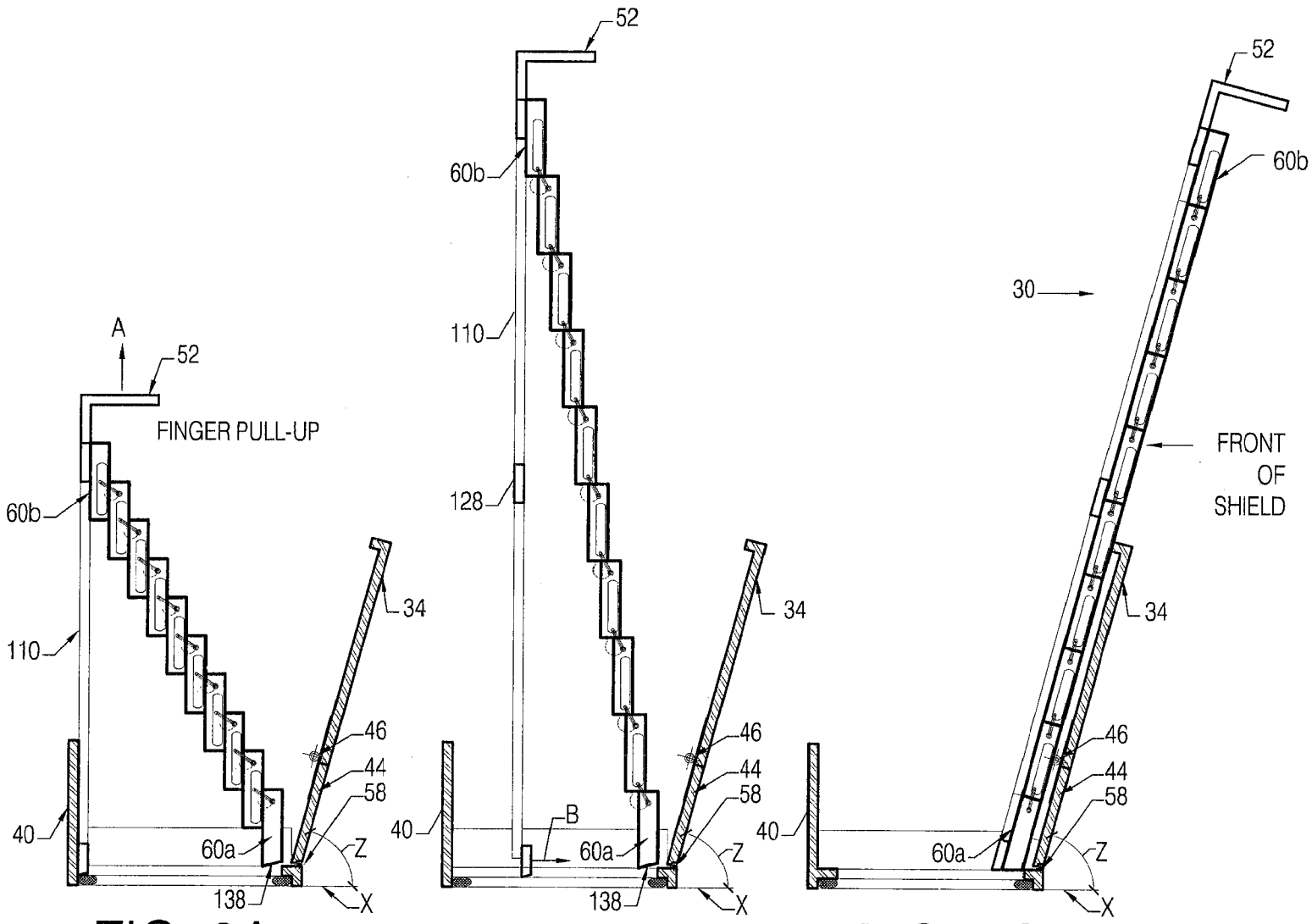
FIG. 9A is an exemplary illustration of a sectional view of the alternate collapsible shield of FIGS. 8A-8C moved to a first partially extended position, according to an aspect of the invention.
FIG. 9B is an exemplary illustration of a sectional view of the alternate collapsible shield of FIGS. 8A-8C in a second partially extended position, according to an aspect of the invention.
FIG. 9C is an exemplary illustration of a sectional view of the alternate collapsible shield in a second (expanded, in use) position, according to an alternative aspect of the invention.
Figure 10:
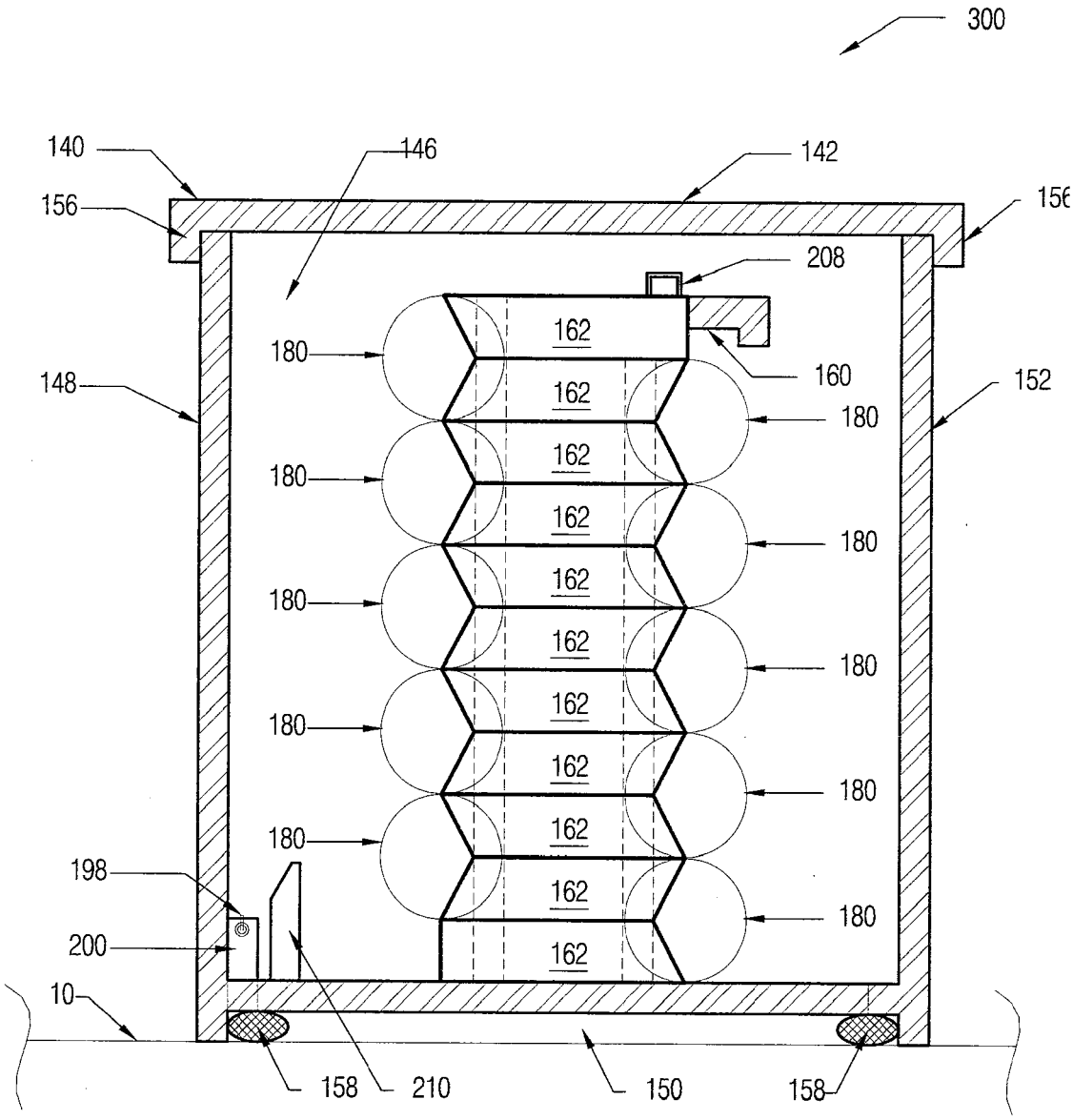
FIG. 10 is an exemplary illustration of a sectional view of a collapsible shield in a first (collapsed, unused) position in a housing, according to yet another aspect of the invention.

Furthermore, one or more segments 60 may be positioned at an angle with respect to the stove. For example, as shown in FIG. 9C, the segments may be positioned at an angle "Z." First segment 60*a* has a first (proximal or bottom) portion 68*a* comprising an angled end 138. First segment 60*a* may be moved and positioned (e.g., pivoted) such that a surface of first portion 68*a* (e.g., angled end 138) is in contact with second (bottom) wall 42 (e.g., see FIG. 9C). An angle of angled end 138 on first portion 68*a* affects an angle at which collapsible shield 30 is moved to with respect to stove 10. Each segment 60*a* . . . 60*n* stacks with respect to one another as described above with respect to FIGS. 7A-7C. However, in this implementation, collapsible shield 30 is provided in a third (open) configuration at a (forward tilting) angle "Z" when moved to the expanded position.

By tilting collapsible shield 30 at an angle, additional room may be provided for a user to access burners 14 of stove 10 (e.g., such as when larger pots are provided on the burners).

The operation of alternate collapsible shield 30 and movement of lock mechanism 110 is now described with reference to FIGS. 9A-9C. Collapsible shield 30 is moved from a first (collapsed, unused) position by flipping or pivoting lid 34 upward about an axis of piano hinge 46. Third (back) wall 44 is also pivoted via hinge mechanism 58 to angle "Z." Manual actuation device 52 may then be grasped by a user and pulled vertically upward as indicated by arrow "A." FIG. 9A depicts collapsible shield 30 in a first, partially extended position, wherein each of the segments 60*a*, 60*b*, . . . 60 are unfolded and moved at least vertically with respect to one another.

As manual actuation device 52 moves vertically upward into a second, partially extended position, as shown in FIG. 9B, lock mechanism 110 is also expanded. Cross braces 112 and 114 are moved and expanded towards a crossed or "X" configuration (as shown in FIG. 6). Additionally, at least a bottom connection point 118 may be moved laterally within housing slot 130 toward third (back) wall 44 of housing 32, as indicated by arrow "B."

Once collapsible shield 30 is moved into a second (expanded, in use) position, the segments 60*a*, 60*b*, . . . 60*n* are unfolded and stacked into the second position, and are supported via cross arm braces 112 and 114. As noted above with respect to FIG. 6, side latches need not be provided in lock mechanism 110. In such an implementation, cross braces 112 and 114 of lock mechanism 110 are configured to automatically lock in place once shield 30 is fully extended into a second (open) position. Additionally, segments 60*a*, 60*b*, . . . 60*n* may be moved to an angle by moving the segments 60*a* . . . 60*n* in a forward direction (e.g., away from stove 10) so that at least bottom portion 68*a* is engaged with second (bottom) wall 42 of housing 32.

To move collapsible shield 30 into the first position, segments 60*a*, 60*b*, . . . 60*n* may be moved backward (e.g., toward stove 10) or downward in a vertical direction. Latch point 126 may be disengaged by pulling manual actuation device 52 vertically upward to release the automatic lock of cross braces 112 and 114. The segments 60*a*-60*n* and lock mechanism 110 may then be lowered (vertically) and collapsed into housing 32.

The dimensions of collapsible shield 30 and each of its constituent parts may vary. For example, segments 60*a*-60*n* may have a length that is equal to or lesser than the length of front edge 20 (or top surface 22) of stove 10. In some implementations (as shown, for example, in FIGS. 4 and 5), one or more (or all) of segments 60*a*-60*n* may comprise a length (L) of approximately 24 inches (in)(or 60.96 centimeters (cm)) to approximately 48 inches (in)(or 121.9 centimeters (cm)). One or more (or each) of segments 60*a*-60*n* may also comprise a width (W) of approximately ½ inch (or 1.3 centimeters), and a thickness (T) of approximately ⅛ inch (or 0.3 centimeters). In one implementation, the attachment area 76 may be formed up to and including a distance (N) of approximately 1/16 of an inch (or 0.2 centimeters) from a top surface of distal portion 70 of segment 60.

Also, each attachment area 76 may comprise any radius/diameter or size designed to receive a connection device, such as pins 86 or 88 of pin hinge 84. For example, attachment area 76 may be formed such that it is approximately 1/32 inch (or 0.1 centimeter) in diameter (D). In an implementation, first and or second pins 86 and/or 88 of pin hinge 84 may comprise a 1/64 inch diameter (or 0.04 centimeters), to thus slide easily into opening of attachment area 76.

Slot 78 may be formed an approximate distance of 1/32 inches (or 0.1 centimeter) below attachment area 76. In some implementations, slot 78 may comprise a length of up to and including approximately 11/32 inch (or 0.9 centimeters), and up to and including approximately ¼ inch (or 0.6 centimeters) in depth. Both slot 78 and opening of attachment area 76 may be formed approximately ¼ inch (or 0.6 centimeters) in depth (P) into an end 64 and/or 66 of a segment 60.

Connection leg 90 may comprise an approximate length of up to and including approximately 9/64 inch (or 0.4 centimeters). When in a second position, collapsible shield 30 may comprise a height (H) of up to and including approximately 6 inches, for example. Again, such dimensions are exemplary only, and should not be viewed as limiting.

The dimensions of housing 32 should also not be viewed as limiting. The dimensions of housing 32 should be configured such that collapsible shield 30, lock mechanism 110, and other constituent parts may be folded or collapsed into channel 38, and secured therein. In some implementations, housing 32 may comprise an overall width of approximately 2 inches (5.1 centimeters), a height of approximately 1 inch (2.54 centimeters), and a length between approximately 24 inches to approximately 48 inches (60.96 centimeters to 121.9 centimeters).

Further, the materials and manufacturing methods for fabricating collapsible shield 30 and the components should likewise not be viewed as limiting. Each of segments 60*a*-60*n* may be formed from heat-resistant plastics, enamels, or a combination thereof, for example, by molding (e.g., injection molding). In some implementations, housing 32 may be formed from metals (e.g., stainless steel), heat-resistant plastics, or a combination thereof. Manual actuation device 52 and elements 112, 114 and 120, 122 of lock mechanism 198 may be formed from similar heat-resistant materials as segments 60*a*-60*n*, or from different materials. The materials and processes used to manufacture the parts of lock mechanism 110 should also not be viewed as limiting. Any or all of such parts of collapsible shield 30, may, for example, be molded or welded.

FIGS. 10-16 illustrate yet another alternate implementation of a collapsible shield 300. It should be understood that collapsible shield 300 of FIGS. 10-16 may include components similar to those represented in the implementation of FIGS. 1-9C, and as described in detail above. For example, although not specifically shown, an attachment portion 26 and/or elevation portion 28 may be used with the collapsible shield 300 of FIGS. 10-16.

Collapsible shield 300 may be configured to be provided or attached on top surface 22 of front edge 20 of a device (e.g., stove 10). More particularly, collapsible shield 300 may be configured to be stored in a housing 140. Housing 140 comprises a length, width, and depth/thickness to house components of collapsible shield 300 when collapsible shield 300 is in a first (collapsed, unused) position. Housing 140 may be secured to top surface 22 of front edge 20 of stove 10, for example. As such, in some implementations, housing 140 may comprise at least a length and a width that are sized based on the dimensions of top surface 22 of stove 10. In some implementations, collapsible shield 300 and housing 140 are removable from front edge 20 of stove 10. A heat-resistant adhesive or glue 158 may be used to attach housing 140 to top surface 22, for example. Other means of attachment (e.g., screws or other fasteners) may be utilized. Alternatively, in another implementation, an attachment portion 26 and/or elevation plate 28 as described above with reference to FIGS. 8A-8C may be used to secure housing 140 to front edge 20 of stove 10.

Housing 140 may comprise a lid 142 and a body 144 for housing collapsible shield 300. Body 144 comprises a channel 146 that is formed from a first (front) wall 148, a second (bottom) wall 150, and a third (back) wall 152 which are connected to form an approximate "U" shape. Channel 146 of body 144 receives the parts of collapsible shield 300 when they are collapsed and not in use, as further described below. Body 144 may be sized or formed such that collapsible shield 300 is easily stored therein. Lid 142 may be removably provided on body 144 and may be provided in a first (closed) configuration (e.g., see FIG. 10) or a second (open, removed) configuration (e.g., see FIG. 14). Lid 34 may also include one or more lips 156 which extend over first (front) wall 148 and/or third (back) wall 152 when in a first (closed) configuration.

In one implementation, collapsible shield 300 comprises a manual actuation device 160 which is attached to collapsible shield 300 to facilitate movement of collapsible shield 300 between a first position and second position. In one implementation, manual actuation device 160 is provided in the form of a pull mechanism which may be pushed or pulled in a vertical direction to respectively collapse or expand collapsible shield 300. Manual actuation device 160 may comprise a non-limiting, substantially "L"-shaped structure as described above, and may be stored within housing 140 when collapsible shield 300 is in a first (collapsed, unused) position. Manual actuation device 160 may be accessed when lid 142 is removed, for example. Manual actuation device 160 may be provided along an entire length of shield 300 or in designated actuation areas for lifting the shield 300. The configuration and placement of manual actuation device 160 is not limited.

Collapsible shield 300 also comprises a plurality of segments 162. Collapsible shield 300 may comprise any number of segments (162*a*, 162*b*, . . . 162*n*). An exemplary implementation of a single segment 162 is represented in a side view in FIG. 11. Each segment 162 may comprise a generally rectangular body 164 that extends horizontally between a right end 166 (see FIG. 12A) and a left end 168 (see FIG. 15) of collapsible shield 300. The length of each segment 162 may be sized based on the dimensions of front edge 20 of stove 10. More particularly, the dimensions of each segment 162 may be formed such that each segment 162 may be inserted (and stored) in channel 146 of housing 140. Each segment 162 also comprises a first (proximal, right) portion 170, a second (distal, left) portion 172, and side (e.g., top and bottom) portions 174 and 176. Each segment 162 also includes at least one slot 178 provided at or adjacent to both ends 166 and 168. Each slot 178 may be used with a connection device to attach a first segment 162*a* to another segment 162*n*. In an implementation, two or more slots 178 may be provided at both ends 166 and 168 of the segment 162. The number of slots 178 provided at each end 166 or 168 may depend on the placement of the noted segment 162 in the collapsible shield 30.

In the illustrated (non-limiting) implementation, for example, each slot 178 may comprise an opening, bore, or passage that extends in a direction perpendicular to the rectangular body through an end of segment 162, as well as at least partially longitudinally/vertically within body 164. Each slot 178 has a proximal end 178A that is provided near the side (bottom) portion 176 and a distal end 178B that is provided near the side (top) portion 174 of segment 162. As described below, the configuration of slot 178 enables vertical and pivotal movement of a second segment 162*b* with regard to a first segment 162*a*, when collapsible shield 300 is moved between a first (collapsed, unused) position and a second (expanded, in use) position, or vice versa.

The design and configuration of slots 178 should not be viewed as limiting. Slots 178 may be formed according to the type of connection device to be used to connect segments 162*a*-162*n* together.

Generally, collapsible shield 300 comprises at least a first (proximal, bottom) segment 162*a* and a second (distal, top) segment 162*b* which are configured to move relative to one another. In one implementation, first segment 162*a* and second segment 162*b* may be directly connected to one another. In one implementation, first segment 162*a* and second segment 162*b* may be connected via a plurality of segments 162 provided therebetween. In either instance, second segment 162*b* is configured such that it moves vertically and is pivoted with respect to first segment 162*a*.

To attach adjacent segments together, a connection device may be used to connect a segment 162 to another segment 162*n*. In the illustrated implementation, a ring 180 is provided within each slot 178. The design and/or dimensions of slots 178 may be configured such that ring 180 may be inserted therein. Rings 180 may comprise a generally circular shape. Rings 180 may be designed such that they may be inserted and mounted into segments 162*a* and 162*b* to thereby connect two adjacent segments of the collapsible shield 300. In an implementation, ring 180 comprises a semi-circular rod that is inserted through slots 178 of adjacent segments 162*a* and 162*b*, and then bent closed to form the generally circular shape (e.g., its ends are moved towards one another to bend the rod body into a closed, circular shape). In an implementation, ends of the rod are connected together after bending. In another implementation, ring 180 may comprise two segments whose first ends are connected together (e.g., via a hinge) and whose second ends can be moved from an open position (to feed or insert second ends through slots 178 of segments 162*a* and 162*b*) to a closed position (to form a closed circular shape after insertion). However, such implementations are exemplary and not meant to be limiting. Rings 180 may be formed from any number of materials, including, but not limited to, stainless steel.

Figure 12B:
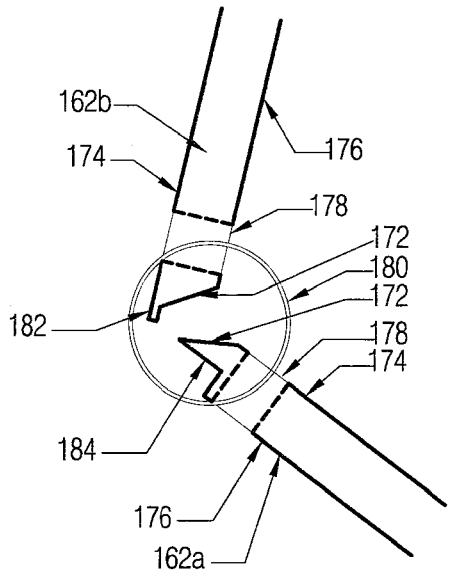
FIG. 12B is an exemplary illustration of a sectional side view of two segments of the collapsible shield taken along the section line indicated in FIG. 12A when moving the two segments toward a second (expanded, in use) position, according to an aspect of the invention.
Figure 12A:
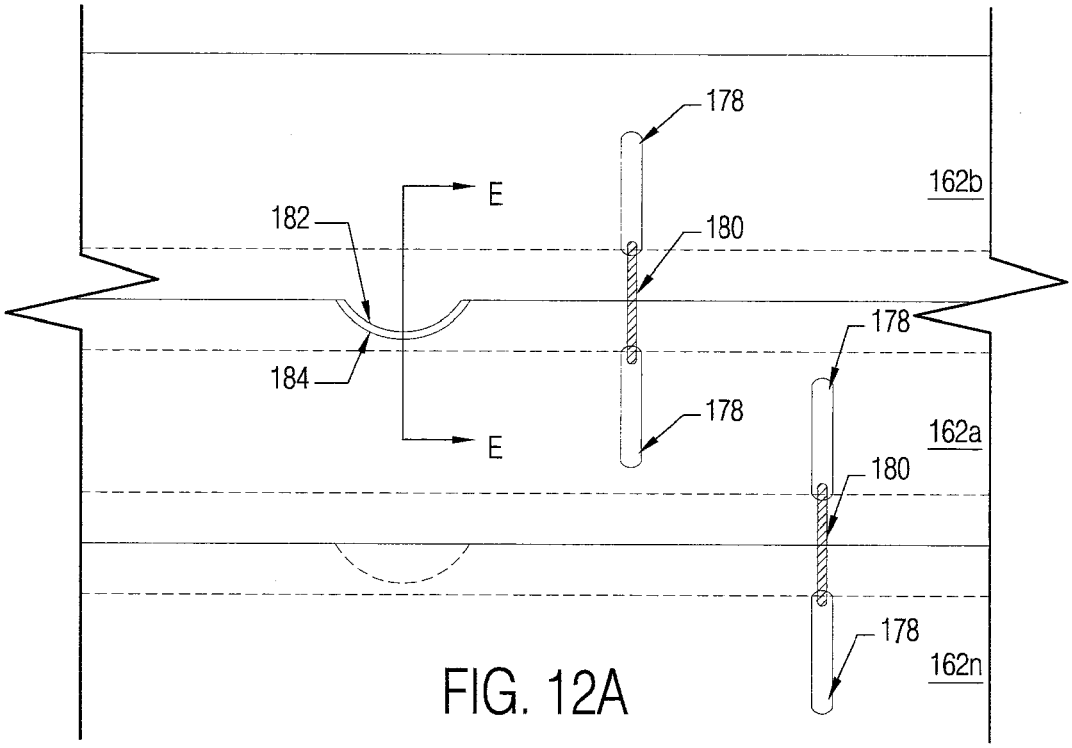
FIG. 12A is an exemplary illustration of a front view of at least two segments of the collapsible shield of FIG. 10 in a second (expanded, in use) position, according to an aspect of the invention.

In an implementation where the two segments 162*a* and 162*b* are directly connected to one another, such as shown in FIGS. 12A and 12B, for example, a connection device in the form of ring 180 connects first segment 162*a* to second segment 162*b* and enables vertical and pivotal movement of the segments relative to one another. For example, as shown in greater detail in FIG. 12A, one or more slots 178 extending through the rectangular body between side portion 174 and side portion 176 are provided at or adjacent each right end 166 of each segment 162*a* and 162*b*. Ring 180 may be inserted through slot 178 of first segment 162*a* as well as slot 178 of an adjacent (second) segment 162*b* to connect the segments together.

In one implementation, ring 180 may be secured into slot 178 of first segment 162*a* as well as slot 178 of second segment 162*b* to connect the segments. Slot 178 of each segment 162 is positioned within the body such that when segments are aligned horizontally, slots 178 align vertically (see, e.g., FIG. 12A). Slot 178 of each segment 162 is also configured such that, as each segment is pulled into a stacked position (or pushed into a collapsed position), each ring 180 can move therein. For example, slot 178 may be configured and sized such that ring 180 can move freely and shift vertically and horizontally therein when the segments 162*a* and 162*b* are moved relative to one another.

Figure 13A:
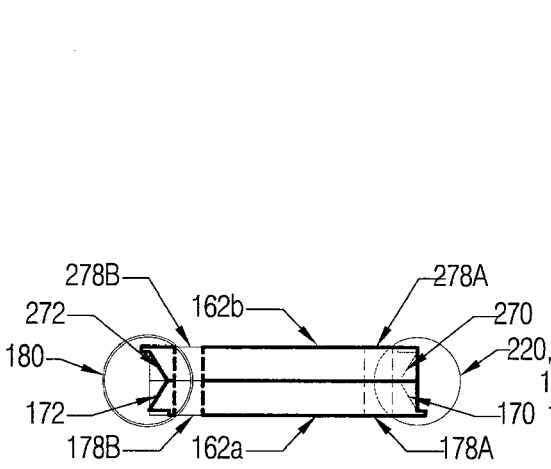
FIGS. 13A-13D are exemplary illustrations of side views of two segments of the collapsible shield of FIG. 10 and their corresponding movement relative to one another from a first (collapsed, unused) position to a second (expanded, in use) position, according to an aspect of the invention.

To further explain the relative movement of segments 162*a* and 162*b*, FIG. 13A+ illustrate first (proximal) segment 162*a* directly connected via at least one ring 180 to second (distal) segment 162*b*, as well as the corresponding movement of parts relative to one another from a first (collapsed, unused) position to a second (expanded, in use) position. However, it should be understood that two segments of collapsible shield 300 which are not directly connected to one another may also move in a similar, vertical, pivoting and translating manner as described herein. For example, rings 230 and/or 220 may be provided in slots 178A and/or 278A of segments 162*a* and/or 162*b* (respectively) so that either or both of segments 162*a* and/or 162*b* may be connected to another segment 162. As such, the description corresponding to FIG. 13A+ should not be limited to two segments which are directly connected to (or adjacent) one another, but should be understood to describe a first (proximal, bottom) segment 162*a* and second (distal, top) segment 162*b*, and their movement with respect to one another, regardless of the number of segments 162*a*-162*n* provided in collapsible shield 300. Moreover, it is to be understood that a plurality of slots and rings may be provided along a longitudinal length of each segment, and that any singular reference to an element (e.g., ring 180, slot 178) and its movement may also refer to relative movement of such elements along the lengths of the segments.

Figure 11:
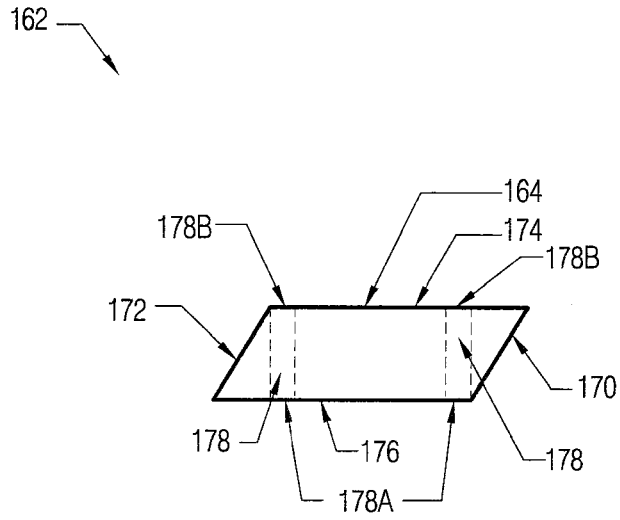
FIG. 11 is an exemplary illustration of a side view of a single segment of the collapsible shield of FIG. 10, according to an aspect of the invention.

First segment 162*a* comprises similar elements described with respect to single segment 162 of FIG. 11, including first portion 170, second portion 172, side portions 174 and 176, and slots 178A and 178B. Second segment 162*b* comprises elements similar to those of first segment 162*a*. For ease of explanation only, second segment 162*b* is described as comprising a body 264 with a first portion 270, second portion 272, side portions 274 and 276, and slots 278A and 278B. However, it should be understood that portions 164 and 264, 174 and 274, etc. are substantially similar in shape and construction for the segments 162, and are therefore interchangeable with regard to the description herein.

Referring back to FIGS. 13A-13D, FIG. 13A illustrates first (proximal) and second (distal) segments 162*a* and 162*b*, respectively, provided adjacent to one another, stacked on top of each other vertically. As shown, ring 180 is threaded through slot 178B of second portion 172 of first (proximal) segment 162*a* and slot 278B of second portion 272 of second (distal) segment 162*b*. First (proximal) portions 170 and 270 and second (distal) portions 172 and 272 are provided adjacent to one another in a generally parallel configuration when the segments 162*a*-162*b* are in a first (collapsed, unused) position. When collapsible shield 300 is moved to a second (expanded, in use) position, at least second segment 162*b* is moved vertically upward from first segment 162*a*.

Figure 13B:
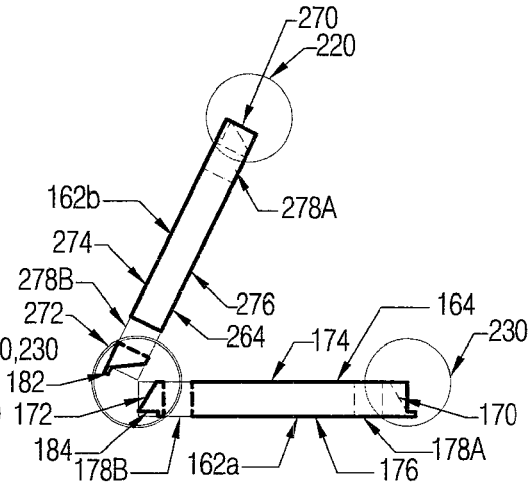

As shown in FIG. 13B, side portion 276 and first portion 270 of second segment 162*b* thus moves away from side portion 174 and first portion 170 of first segment 162*a* (e.g., when a manual lifting force is applied to manual actuation device 160). Second (distal) portion 272 also moves pivotally and vertically away from second (distal) portion 172 of first segment 162*a*. Also, ring 180 moves freely within slot 178B (of first segment 126*a*) and slot 278B (of second segment 162*b*) as second segment 162*b* is rotated and lifted.

Figure 13C:
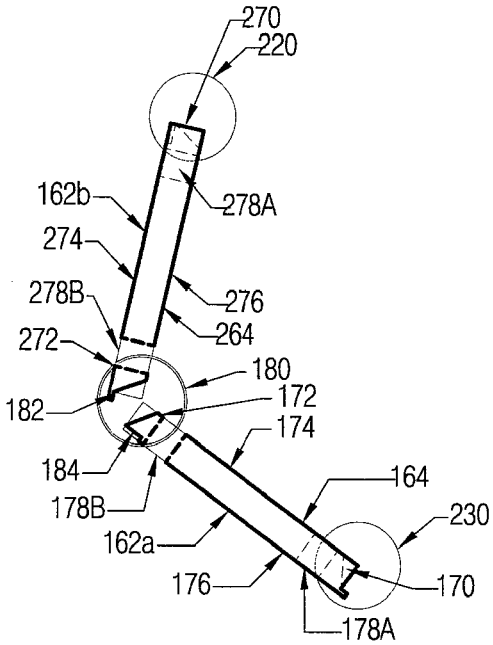
Figure 13D:
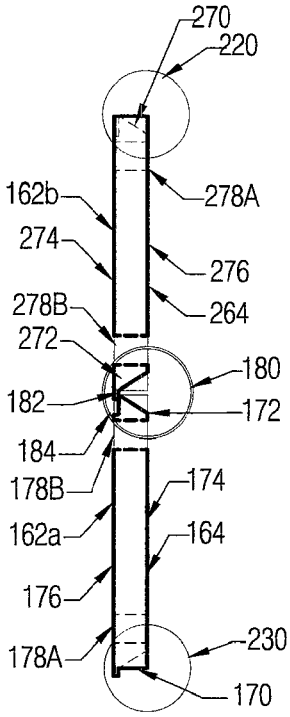

As second segment 162*b* continues to move vertically and ring 180 is moved within slots 178B and 278B, second (distal) portion 172 of first segment 162*a* is also lifted and moved vertically such that first segment 162*a* is also pivoted at first (proximal) portion 170 (e.g., via ring 230), as shown in FIG. 13C. More particularly, ring 180 (and 230) enables further rotation of second segment 162*b* with respect to first segment 162*a*, thereby moving second (distal) portion 272 of second segment 162*b* into an adjacent and stacked configuration with second (distal) portion 172 of first segment 162*a*, as shown in FIG. 13D.

It should be understood that a similar yet opposite movement may be described with regard to the first and second segments 162*a* and 162*b* when collapsible shield 300 is moved from a second (expanded, in use) position to a first (collapsed, unused) position. That is, from the stacked configuration, second segment 162*b* pivots relative to first segment 162*a*, and moves vertically (downward) back to a generally parallel configuration.

In one implementation, first segment 162*a* may be attached to part of housing 140 via a bracket or hinge mechanism, such as within channel 146 to second (bottom) side 150 of housing 140. Second segment 162*b* may be attached to manual actuation device 160 via an adhesive such as, for example, a heat-resistant glue (other attachment means (e.g., screws or other fasteners) may be used. As such, when collapsible shield 300 is moved via manual actuation device 160 from a first position to a second position, second segment 162*b* moves in a relatively vertical direction and is pivoted with respect to first segment 162*a*, such that the segments 162*a* and 162*b* are in a stacked configuration.

Figure 15:
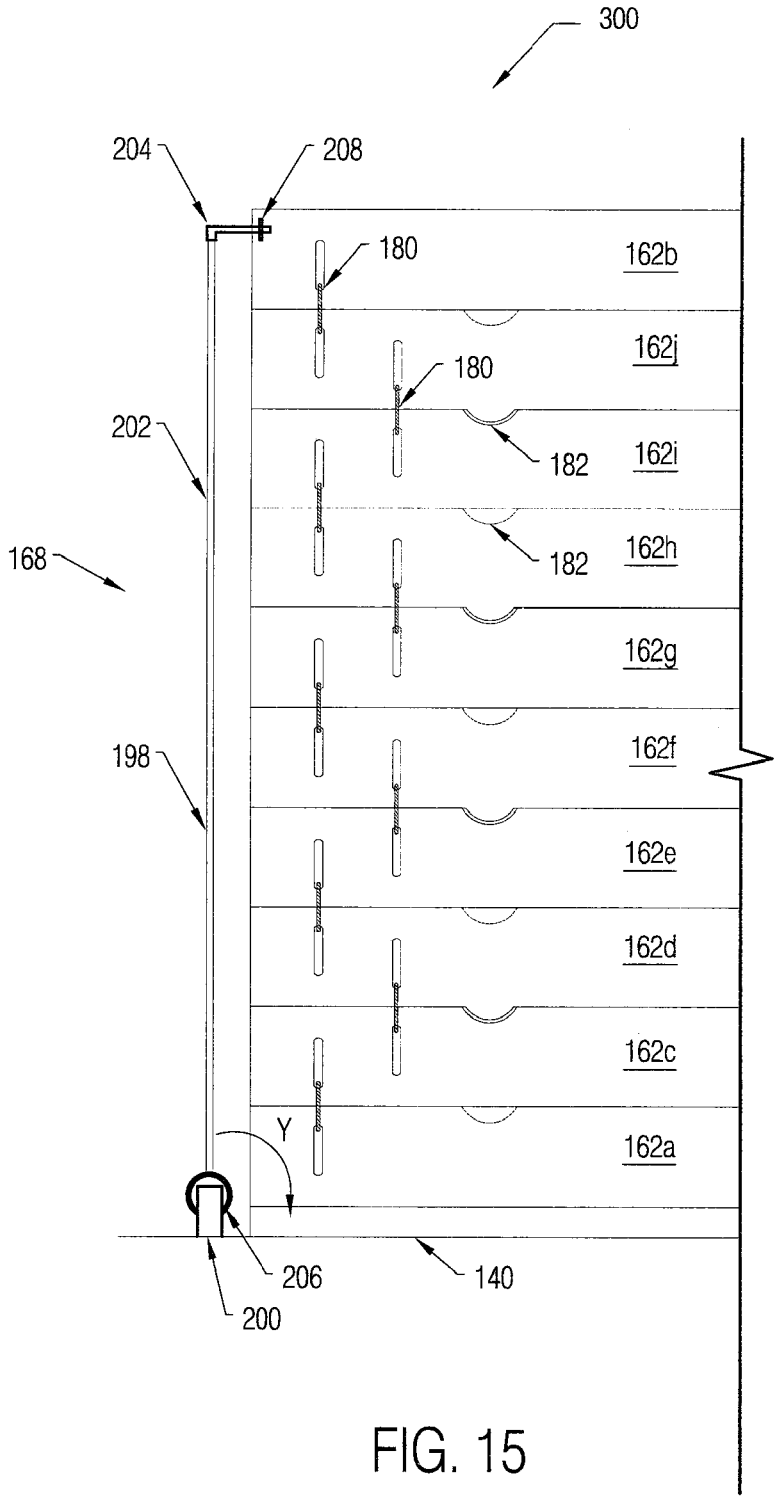
FIG. 15 is an exemplary illustration of a front view of the collapsible shield of FIG. 10 in a second (expanded, in use) position with yet another alternate lock mechanism, according to an aspect of the invention.

In one implementation, when collapsible shield 300 is moved to a second position, the at least first and second segments 162*a* and 162*b* may be reinforced in their stacked configuration by one or more stoppers 182 provided along the body of each segment. More specifically, as shown in the detailed view of FIG. 12B, a stopper 182 may be provided on segment 162*b*. Stopper 182 may be provided on side (top) portion 174 or side (bottom) portion 176 of each segment 162 (e.g., see FIG. 11), or both (e.g., see FIGS. 12*a* and 15, showing stoppers 182 provided in an alternating manner on front and back sides of alternating segments 162 of collapsible shield 300). Each stopper 182 may be formed integrally with corresponding segment 162 (e.g., molded) or machined and mounted to a segment. Also shown in FIG. 12B is a corresponding recess 184 formed within segment 162*a*. Recesses 184 are formed in a location on segment 162 that corresponds to a location for receipt of stopper 182 when the segments are stacked in an expanded (in use) position with respect to one another. Recess 184 may be configured to receive stopper 182 therein when the at least first and second segments 162*a* and 162*b* are in a stacked configuration. Like stoppers 182, recesses 184 may be provided on side (top) portions 174 and/or side (bottom) portion 176 of each segment (e.g., see FIG. 11), or both. For example, as shown in FIG. 12A, which represents section E-E in FIG. 12A, as adjacent segments 162*a* and 162*b* are moved toward a second (expanded, in use) position, stopper 182 of segment 162*b* is received in recess 184 of segment 162*a*. When segments 162*a* and 162*b* are in the second (or a third), in use position, stoppers 182 assist in stabilizing the segments 162 through their alignment in recesses 184. For example, stoppers may keep segments 162 from disengaging from each other so that they remain in an expanded, upright (in use) position. As shown in FIGS. 13A-13D, when the segments 162*a* and 162*b* are moved from a first position to a second position, the stoppers 182 of second segment 162*b* align within recesses 184 of first segment 162*a* to assist in stabilizing collapsible shield 300 in the second stacked position.

In an implementation, when collapsible shield 300 is moved to a second position, the at least first and second segments 162*a* and 162*b* may be secured in their stacked configuration by an alternate lock mechanism 198. Lock mechanism 198 may be configured to secure collapsible shield 300 after it is moved between a first (collapsed, unused) position and a second (expanded, in use) position. It should be recognized that any type of lock mechanism for securing segments in a stacked or vertical configuration may be used with the various collapsible shield configurable disclosed herein. For example, in an implementation, lock mechanism 110 (e.g., see FIG. 6) may also be used with collapsible shield 300 for securing segments 162*a*-162*n* in a second or stacked configuration.

FIG. 15 illustrates a first (left) part of lock mechanism 198 in greater detail. Although only a first (left) part of lock mechanism 198 is shown, it is to be understood that a second (right) part of lock mechanism 198 that is substantially similar to the first (left) part of lock mechanism 198 is also provided.

As shown, collapsible shield 300 is in a second (expanded, in use) position. First (left) part and second (right) part of lock mechanism 198 (only a first part being shown in FIG. 15) may each include a rod body 202 connected via a pivot connection at a proximal end to a bottom part 200 and a hook 204 at a distal end. Bottom part 200 may be mounted within housing 140, for example (see also FIG. 10). Rod body 202 is configured to move with respect to bottom part 202 via its pivot connection. In an implementation, rod body 202 may also be configured to move rotationally with respect to bottom part 200. In an implementation, rod body 202 comprises a round eye loop 206 at a proximal end that is connected to bottom part 200 to enable movement (e.g., pivotal and/or rotational) with respect to bottom part 200. Rod body 202 may comprise a predetermined length that corresponds to a height and/or an angle at which the plurality of segments 162 may be provided when in a second (expanded, in use) position.

Hook 204 may be configured to be securely attached to (or within) an attachment portion 208 of collapsible shield 300 so that the shield is locked in a second (expanded, in use) position. For example, FIG. 15 shows that second segment 162*b* comprises attachment portion 208 at or adjacent left end 168 for receiving hook 204 therein. Also, although not shown, it is to be understood that right 166 of second segment 162*b* also comprises another attachment portion 208 thereon.

In one implementation, lock mechanism 198 may be configured to be stored within housing 140. For example, lock mechanism 198 may be secured within channel 146 of housing 140 by pivoting each rod body 202 (e.g., pivoting a first (left) and a second (right) rod body 202) about its pivot connection towards an end that is opposite its corresponding bottom 200 such that rod body 202 lies substantially horizontally within housing 140 when not in use (i.e., when collapsible shield 130 is in a first (collapsed, unused) position). FIG. 15 illustrates how first (left) part of the lock mechanism 198 is pivoted in a downward direction toward housing, indicated by arrow "Y," for storage.

In operation, collapsible shield 300 may be moved from a first (collapsed, unused) position by removing lid 142 (e.g., lifting) from body 144. Manual actuation device 160 may then be grasped by a user and pulled in a vertical upward direction (e.g., in a similar manner as indicated by arrow "A" in FIG. 7A). Each of the segments 162*a*, 162*b*, . . . 162*n* is unfolded and moved at least vertically and pivotally with respect to one another.

As manual actuation device 160 moves vertically upward into a second, partially extended position, rings 180 are moved within slots 178. Slots 178 are formed to house the diameter of the ring and allow free movement of rings therein. Rings 180 assist in both attaching neighboring segments together as well as moving segments between first and second positions.

Figure 14:
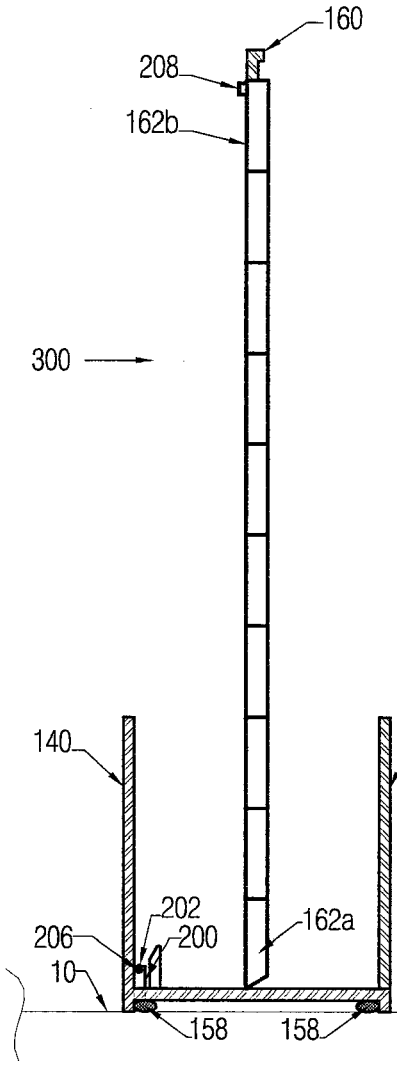
FIG. 14 is an exemplary illustration of a sectional view of the collapsible shield of FIG. 10 in a second (expanded, in use) position, according to an aspect of the invention.

Once collapsible shield 300 is moved into a second (expanded, in use) position, as shown in FIG. 14, for example, each rod body 202 of lock mechanism 198 provided in housing 140 may be grasped and pivoted about eye 206 with respect to bottom part 200 (e.g., in an opposite direction as indicated by arrow "Y" in FIG. 15). Hooks 204 are then inserted into each attachment portion 208 provided on end 166, 168 of segment 162*b*. The segments 162*a*, 162*b*, . . . 162*n* are all unfolded and stacked into a second position, and are supported by the length of rod body 202. The length of rod body 202 provides enough strength and resistance to prevent the plurality of segments 162 from collapsing or moving toward a first (collapsed, unused) position.

To move collapsible shield 300 into a first position, each hook 204 is disengaged by pulling each hook 204 out of attachment portion 208 and pivoting each rod body 202 downward toward (and into) housing 140 (as indicated by arrow "Y" in FIG. 15). The segments 162*a*-162*n* may then be lowered (vertically) downward and collapsed into housing 140.

Although a plurality of segments 162*c*, 162*d*, . . . 162*j* are shown between first (lowermost) segment 162*a* and second (uppermost) segment 162*b* which form collapsible shield 300, it should be understood that the number of such segments 162*c*-162*j* are not meant to be limiting. Further, in some implementations, a plurality of segments need not be provided between first segment 162*a* and second segment 162*b*. For example, it is within the scope of the invention that other devices which may be collapsed, rolled, or folded to a first (collapsed, unused) configuration (or position) and expanded to a second (expanded, in use) configuration (or position) may be attached to first and second segments 162*a* and 162*b* to form collapsible shield 300.

Figure 16:
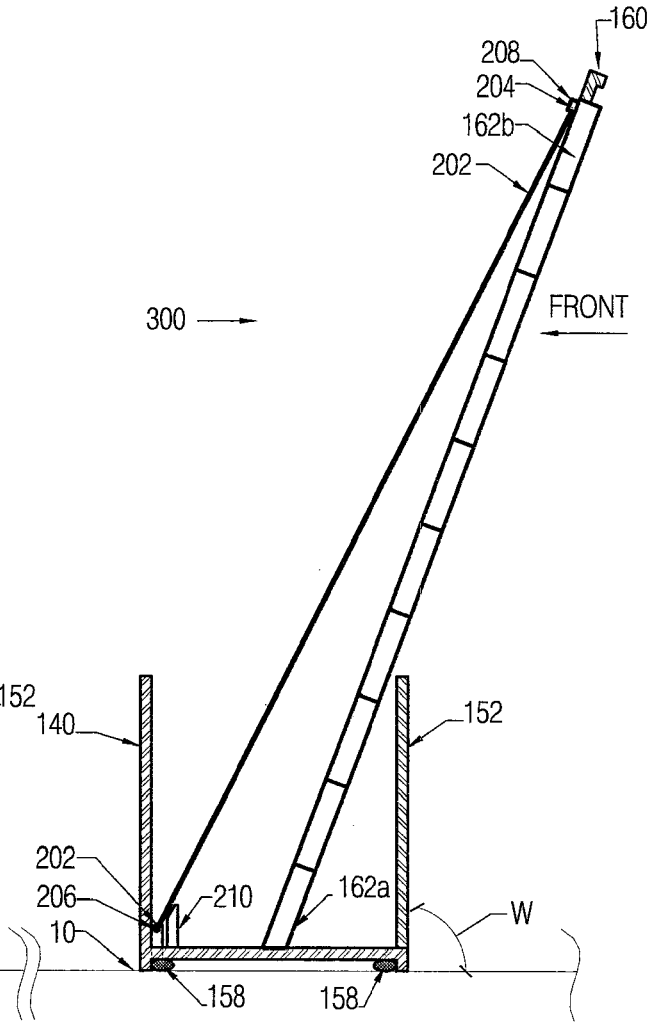
FIG. 16 is an exemplary illustration of a sectional view of the alternate collapsible shield of FIG. 15 in a second (expanded, in use) position, according to yet another alternative aspect of the invention.

FIG. 16 additionally depicts collapsible shield 300 in a third (tilted, forward) direction. As previously noted, each segment 162 may comprise a second (distal) portion 172 which comprises an angled edge. Like angled end 138 of the implementation shown in FIGS. 8A and 9A-9C, the angled edge of second portion 172 enables first segment 162*a* to be moved and positioned such that a surface of second portion 172 is in contact with second (bottom) wall 150 of housing 140. Angled end 138 on second portion 172 may determine an angle at which collapsible shield 30 is moved to with respect to stove 10. In an implementation, collapsible shield 300 may be secured in a third (tilted, forward) direction at an angle "W." In one implementation, angle "W" is within a range of 60 degree to 80 degrees. In another implementation, angle "W" is 75 degrees. Other angles may be utilized. Each segment 60*a* . . . 60*n* stacks with respect to one another as described above. However, in this implementation, collapsible shield 300 is provided in a third (open) configuration at a (forward tilting) angle "W" when or after being moved to the expanded position. In an implementation, one or more supports 210 may be provided within housing 140 to assist in positioning and stabilizing rod body 202 at angle "W." Also, it should be noted that the length of rod body 202 of lock mechanism 198 may be adjusted in order to secure the plurality of segments 162 at angle "W" when in a second (expanded, in use) position.

By tilting collapsible shield 300 at an angle, additional room may be provided for a user to access burners 14 of stove 10 (e.g., such as when larger pots are provided on the burners), for example.

The operation of collapsible shield 300 and movement of alternate lock mechanism 198 is similar to the implementation as described above with reference to FIG. 14. For example, collapsible shield 300 may be moved from a first (collapsed, unused) position by removing lid 142 from body 144. Manual actuation device 160 may then be grasped by a user and pulled vertically upward. Once collapsible shield 300 is moved into a second (expanded, in use) position, the segments 162*a*, 162*b*, . . . 162*n* are unfolded and stacked into the second position. Each rod body 202 of lock mechanism is pivoted about its pivot connection in an upward direction and hook 204 is inserted into a corresponding attachment portion 208. Additionally, segments 162*a*, 162*b*, . . . 162*n* may be moved to an angle by moving the segments 162*a* . . . 162*n* in a forward direction (e.g., away from stove 10). In an implementation, at least second portion 172 is engaged with second (bottom) wall 150 of housing 140.

To move collapsible shield 300 into the first position, each hook 204 is disengaged from attachment portion 208 by pulling outwardly. Each rod body 202 may then be pivoted about eye 206 downwardly into housing 140 for storage. The segments 162*a*-162*n* may then be moved back by an angle and vertically lowered and collapsed into housing 140.

Like the above-illustrated and described implementations, collapsible shield 300 and each of its constituent parts should not be limited by dimension. Although the segments 162 of shield 300 are stacked vertically with respect to one another, the lengths, widths, and thicknesses of the segments 162 should not be limited. For example, in an implementation, segments 162*a*-162*n* may comprise a length (L), a width (W), and a thickness (T) similar to the dimensions provided above. When in a second position, collapsible shield 300 may comprise a height (H) of up to and including approximately 6 inches, for example. Again, such dimensions are exemplary only, and should not be viewed as limiting.

The dimensions of housing 140 should also not be viewed as limiting. The dimensions of housing 140 should be configured such that collapsible shield 300, lock mechanism 198, and other parts may be folded or collapsed into channel 146, and secured therein. In some implementations, housing 32 may comprise an overall width of approximately 1 inch (2.54 centimeters), a height of approximately 2 inches (5.1 centimeters), and a length between approximately 24 inches to approximately 48 inches (60.96 centimeters to 121.9 centimeters).

Also, the materials and manufacturing methods for fabricating collapsible shield 300 and the components should likewise not be limiting. Each of segments 162*a*-162*n* may be formed from heat-resistant plastics, enamels, or a combination thereof, for example, by molding (e.g., injection molding). In some implementations, housing 140 may be formed from metals (e.g., stainless steel), heat-resistant plastics, or a combination thereof. Manual actuation device 160 and one or more parts of lock mechanism 198 may be formed from similar heat-resistant materials as segments 162*a*-162*n*, or from different materials. The materials and processes used to manufacture the parts of lock mechanism 198 should also not be limiting. Any or all of such parts of collapsible shield 300, may, for example, be molded or welded.

Collapsible shield 30 and/or 300 may remain on stove 10 when not in use, and do not require separate removal or storage because it folds onto itself and is concealed in housing 32 or 140 (which is provided on front edge 20 of stove 10). In summary, collapsible shield 30, 300 acts as a safeguard in a second (expanded, in use) position by limiting and/or preventing access to (or interaction with) items on a stove top 12, including, for example, burners 14 or pots and/or pans (and the liquids or food items therein) on burners 14, and by protecting from splashes, spatters, or spills (e.g., when items are being heated or if pulled from stove top 12). This helps prevent possible burns or injuries that may occur to individuals around the stove 10, for example. Additionally, collapsible shields 30 and/or 300 may be used in other applications. For example, a collapsible shield may be used with a workstation to prevent access to tools or other items on a surface thereon. It may further be used with other devices, including those for which safety may not necessarily be a concern. For example, it may be used as a device for shielding visibility or access to items.

Other implementations, uses and advantages of the invention will be apparent to those skilled in the art from consideration of the specification and practice of the invention disclosed herein. The specification should be considered exemplary only, and the scope of the invention is accordingly intended to be limited only by the following claims.

What is claimed is:

1. A collapsible shield configured to be attached to a surface of a device, the collapsible shield comprising:

at least a first segment and a second segment, each segment comprising a top portion, a bottom portion, a front portion, a back portion, and left and right end portions forming a generally rectangular body configured to extend horizontally in relation to the surface of the device;

the at least first segment and the second segment configured for movement between a first, collapsed position that provides access to the surface of the device and a second, expanded position that limits access to the surface of the device;

each segment comprising a slot and an attachment area provided at or adjacent each of the left and the right end portions, the slot comprising a length extending vertically between the top and bottom portions of the generally rectangular body of each segment and the attachment area being separate from the slot; and the at least first segment and the second segment being connected to one another by connection devices, each connection device having a first portion provided in the attachment area of the first segment and a second portion provided in the slot of the second segment;

wherein the connection devices comprise pin hinges or rings and enable vertical and pivotal movement of the second segment with respect to the first segment, and wherein the second segment is configured to move in a vertical and a pivotal direction with respect to the first segment when the collapsible shield is moved between the first, collapsed position and the second, expanded position, or vice versa, and wherein the generally rectangular body of the first segment and the generally rectangular body of the second segment are stacked in a vertical configuration with respect to one another in the second, expanded position.

2. The collapsible shield of claim 1, wherein the device is a stove comprising a top surface and a number of burners on the top surface, and wherein the collapsible shield is attached to the top surface in a position in front of the number of burners so as to limit access to the burners and top surface of the stove.

3. The collapsible shield of claim 1, further comprising:

a housing attached to the surface of the device, the housing comprising an elongate body configured to store the at least first segment and the second segment when the collapsible shield is in the first, collapsed position.

4. The collapsible shield of claim 1, wherein the housing further comprises a lid for covering the elongate body and limiting access to the collapsible shield therein.

5. The collapsible shield of claim 1, further comprising:

a manual actuation device attached to the collapsible shield to move collapsible shield between the first, collapsed position and the second, extended position.

6. The collapsible shield of claim 1, wherein a horizontal length of each segment is determined based on dimensions of the surface of the device.

7. The collapsible shield of claim 1, wherein the first and at least second segments are stacked in a horizontal configuration relative to each other when in the first, collapsed position.

8. The collapsible shield of claim 1, wherein the first and at least second segments are stacked in a vertical configuration relative to each other when in the first, collapsed position.

9. The collapsible shield of claim 1, further comprising:

a lock mechanism for securing the at least first segment and the second segment in their stacked, vertical configuration in the second, expanded position.

10. The collapsible shield of claim 9, wherein the lock mechanism is in a collapsed position when the collapsible shield is in the first, collapsed position and wherein the lock mechanism is in an expanded position when the collapsible shield is in the second, expanded position.

11. The collapsible shield of claim 10, wherein the lock mechanism comprises cross braces configured to be moved vertically between a first position and a second position, and wherein the cross braces are collapsed in the first position and vertically extended in the second position.

12. The collapsible shield of claim 1, wherein the collapsible shield is attached to the surface of the device using an elevation plate configured to provide the collapsible shield at a height above the surface.

13. The collapsible shield of claim 1, wherein the collapsible shield is configured to be moved to a third, tilted position such that the at least first and the second segments are stacked in a vertical configuration with respect to each other and positioned at an angle with respect to the surface of the device.

14. A collapsible shield configured to be attached to a stove having a top surface and a number of burners on the top surface, the collapsible shield comprising:

a plurality of interconnected segments, each segment comprising a top portion, a bottom portion, a front portion, a back portion, and left and right end portions forming a generally rectangular body configured to extend horizontally in relation to the top surface of the stove;

each segment further comprising at least one slot provided at or adjacent the left end portion and at least one slot provided at or adjacent the right end portion;

the plurality of interconnected segments being connected to one another by connection devices provided through the slots, each connection device configured to connect adjacent segments to one another;

the plurality of interconnected segments configured for movement between a first, collapsed position that provides access to the top surface of the stove and a second, expanded position that limits access to the top surface of the stove; and a housing attached to the stove, the housing comprising a body configured to store the plurality of interconnected segments therein when the collapsible shield is in the first, collapsed position;

wherein the connection devices comprise closed, substantially circular rings inserted through each of the slots of the connected adjacent segments, and enable vertical and pivotal movement of the plurality of interconnected segments when the plurality of interconnected segments is moved between the first, collapsed position and the second, expanded position, or vice versa, and wherein the bodies of the plurality of interconnected segments is stacked in a vertical configuration with respect to one another in the second, expanded position.

15. The collapsible shield of claim 1, wherein the connection devices comprise pin hinges; wherein each pin hinge has a first pin at one end and a second pin at an opposite end; wherein the first pin of each pin hinge is inserted into the attachment area of the first segment and wherein the second pin of each pin hinge is inserted into the slot of the second segment to connect the first and second segments together, wherein the first pin is configured for rotational movement within the attachment area and wherein the second pin is configured for vertical and pivotal movement within each slot during movement of the collapsible shield between the first, collapsed position and the second, expanded position.

16. The collapsible shield of claim 13, wherein the bottom portion of the at least the first segment comprises an angled end configured for placement in a position parallel and relative to the surface of the device after the movement of the collapsible shield into the third, tilted position.

17. The collapsible shield of claim 14, wherein the body of the housing comprises a bottom wall, side walls, and a lid, and wherein the body further comprises a hinge mechanism that configures one of the side walls for pivotal movement with respect to the other side walls of the housing and stove.

18. The collapsible shield of claim 17, wherein the collapsible shield is configured to be moved to a third, tilted position wherein the plurality of interconnected segments are expanded and stacked in a vertical configuration with respect to each other and wherein the stacked plurality of interconnected segments are positioned at an angle with respect to the surface of the device.

19. The collapsible shield of claim 18, wherein at least one segment of the plurality of segments comprises an angled end configured for placement in contact with the bottom wall of the housing for positioning the collapsible shield in the third, tilted position, and wherein the angled end is substantially parallel to the top surface of the stove.

20. The collapsible shield of claim 14, wherein the slots of the plurality of interconnected segments are aligned vertically in the second, expanded position.

21. A collapsible shield configured to be attached to a surface of a device, the collapsible shield comprising:

at least a first segment and a second segment, each segment comprising a top portion, a bottom portion, a front portion, a back portion, and left and right end portions forming a generally rectangular body configured to extend horizontally in relation to the surface of the device;

the at least first segment and the second segment configured for movement between a first, collapsed position that provides access to the surface of the device and a second, expanded position that limits access to the surface of the device;

each segment comprising a slot and an attachment area provided at or adjacent each of the left and the right end portions, the slot comprising a length extending vertically between the top and bottom portions of the generally rectangular body of each segment and the attachment area being separate from the slot; and the at least first segment and the second segment being connected to one another by connection devices, each connection device having a first portion provided in the attachment area of the first segment and a second portion provided in the slot of the second segment;

wherein the connection devices enable vertical and pivotal movement of the second segment with respect to the first segment, wherein the second segment is configured to move in a vertical and a pivotal direction with respect to the first segment when the collapsible shield is moved between the first, collapsed position and the second, expanded position, or vice versa, wherein the generally rectangular body of the first segment and the generally rectangular body of the second segment are stacked in a vertical configuration with respect to one another in the second, expanded position, and wherein the first and at least second segments are stacked in a horizontal Configuration relative to each other when in the first, collapsed position.

22. A collapsible shield configured to be attached to a surface of a device, the collapsible shield comprising:

at least a first segment and a second segment, each segment comprising a top portion, a bottom portion, a front portion, a back portion, and left and right end portions forming a generally rectangular body configured to extend horizontally in relation to the surface of the device;

the at least first segment and the second segment configured for movement between a first, collapsed position that provides access to the surface of the device and a second, expanded position that limits access to the surface of the device;

each segment comprising a slot and an attachment area provided at or adjacent each of the left and the right end portions, the slot comprising a length extending vertically between the top and bottom portions of the generally rectangular body of each segment and the attachment area being separate from the slot; and the at least first segment and the second segment being connected to one another by connection devices, each connection device having a first portion provided in the attachment area of the first segment and a second portion provided in the slot of the second segment;

wherein the connection devices enable vertical and pivotal movement of the second segment with respect to the first segment, and wherein the second segment is configured to move in a vertical and a pivotal direction with respect to the first segment when the collapsible shield is moved between the first, collapsed position and the second, expanded position, or vice versa, and wherein the generally rectangular body of the first segment and the generally rectangular body of the second segment are stacked in a vertical configuration with respect to one another in the second, expanded position; and wherein the collapsible shield is attached to the surface of the device using an elevation plate configured to provide the collapsible shield at a height above the surface.

23. A collapsible shield configured to be attached to a surface of a device, the collapsible shield comprising:

at least a first segment and a second segment, each segment comprising a top portion, a bottom portion, a front portion, a back portion, and left and right end portions forming a generally rectangular body configured to extend horizontally in relation to the surface of the device;

the at least first segment and the second segment configured for movement between a first, collapsed position that provides access to the surface of the device and a second, expanded position that limits access to the surface of the device;

each segment comprising a slot and an attachment area provided at or adjacent each of the left and the right end portions, the slot comprising a length extending vertically between the top and bottom portions of the generally rectangular body of each segment and the attachment area being separate from the slot; and the at least first segment and the second segment being connected to one another by connection devices, each connection device having a first portion provided in the attachment area of the first segment and a second portion provided in the slot of the second segment;

wherein the connection devices enable vertical and pivotal movement of the second segment with respect to the first segment, and wherein the second segment is configured to move in a vertical and a pivotal direction with respect to the first segment when the collapsible shield is moved between the first, collapsed position and the second, expanded position, or vice versa, and wherein the generally rectangular body of the first segment and the generally rectangular body of the second segment are stacked in a vertical configuration with respect to one another in the second, expanded position; and wherein the collapsible shield is configured to be moved to a third, tilted position such that the at least first and the second segments are stacked in a vertical configuration with respect to each other and positioned at an angle with respect to the surface of the device.

24. A collapsible shield configured to be attached to a stove having a top surface and a number of burners on the top surface, the collapsible shield comprising:

a plurality of interconnected segments, each segment comprising a top portion, a bottom portion, a front portion, a back portion, and left and right end portions forming a generally rectangular body configured to extend horizontally in relation to the top surface of the stove;

each segment further comprising at least one slot provided at or adjacent the left end portion and at least one slot provided at or adjacent the right end portion;

the plurality of interconnected segments being connected to one another by connection devices provided through the slots, each connection device configured to connect adjacent segments to one another;

the plurality of interconnected segments configured for movement between a first, collapsed position that provides access to the top surface of the stove and a second, expanded position that limits access to the top surface of the stove; and a housing attached to the stove, the housing comprising a body configured to store the plurality of interconnected segments therein when the collapsible shield is in the first, collapsed position, and wherein the body of the housing comprises a bottom wall, side walls, and a lid, and wherein the body further comprises a hinge mechanism that configures one of the side walls for pivotal movement with respect to the other side walls of the housing and stove;

wherein the connection devices enable vertical and pivotal movement of the plurality of interconnected segments when the plurality of interconnected segments is moved between the first, collapsed position and the second, expanded position, or vice versa, and wherein the bodies of the plurality of interconnected segments is stacked in a vertical configuration with respect to one another in the second, expanded position.

* * * * *